US009205660B2

(12) United States Patent
Yoshida et al.

(10) Patent No.: US 9,205,660 B2
(45) Date of Patent: Dec. 8, 2015

(54) LIQUID CONSUMING APPARATUS WITH A MOVABLE HOLDER HAVING AN INCLINED FACE

(71) Applicant: Seiko Epson Corporation, Tokyo (JP)

(72) Inventors: Junpei Yoshida, Matsumoto (JP); Masaki Tsukida, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/629,909

(22) Filed: Feb. 24, 2015

(65) Prior Publication Data

US 2015/0251434 A1 Sep. 10, 2015

(30) Foreign Application Priority Data

Mar. 5, 2014 (JP) ..... 2014-042990

(51) Int. Cl.
*B41J 2/175* (2006.01)

(52) U.S. Cl.
CPC ..... *B41J 2/1752* (2013.01)

(58) Field of Classification Search
CPC .. B41J 2/17566; B41J 2/17546; B41J 2/1752; B60N 3/106
USPC ..... 347/19, 86; 356/436; 250/577
See application file for complete search history.

(56) References Cited

U.S. PATENT DOCUMENTS

| | | | | |
|---|---|---|---|---|
| 6,767,075 | B1 * | 7/2004 | Takada et al. | 347/19 |
| 2013/0114084 | A1 * | 5/2013 | Kamiyanagi et al. | 356/436 |
| 2013/0222445 | A1 | 8/2013 | Nishihara | |
| 2013/0320248 | A1 * | 12/2013 | Yoshida et al. | 250/577 |

FOREIGN PATENT DOCUMENTS

| | | | |
|---|---|---|---|
| JP | 2013-099890 | A | 5/2013 |
| JP | 2013-169785 | A | 9/2013 |
| JP | 2013-248738 | A | 12/2013 |
| JP | 2014-019048 | A | 2/2014 |

* cited by examiner

*Primary Examiner* — Julian Huffman
*Assistant Examiner* — Carlos A Martinez

(57) ABSTRACT

The liquid consuming apparatus includes a detection portion 90 having a light-emitting portion 92 and a light-receiving portion 94, a holder 20 in which a liquid container provided with a prism 170 is attachably and detachably installed, the holder 20 having an opening portion 22 provided at a position facing the prism 170 when the liquid container is installed, and a reflection portion 24, and a moving portion that relatively moves the holder in a first direction with respect to the detection portion 90. A first portion of the holder 20 that is peripheral to the reflection portion 24 in a plan view of the holder 20 as seen from the side of the detection portion 90 has an inclined face that inclines in a second direction intersecting the first direction.

8 Claims, 17 Drawing Sheets

FIG. 14A
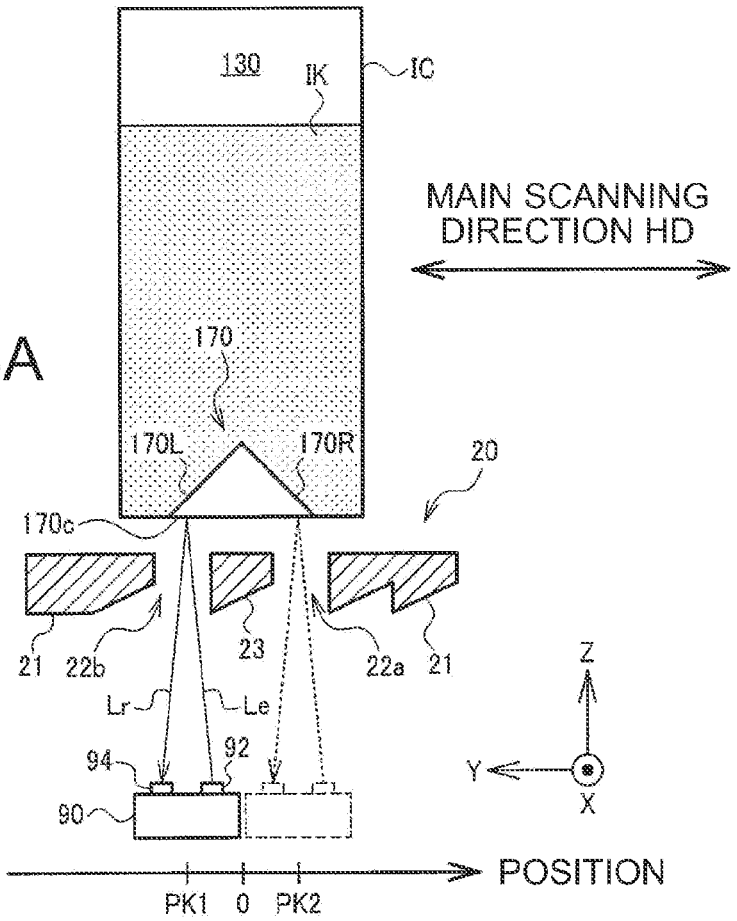
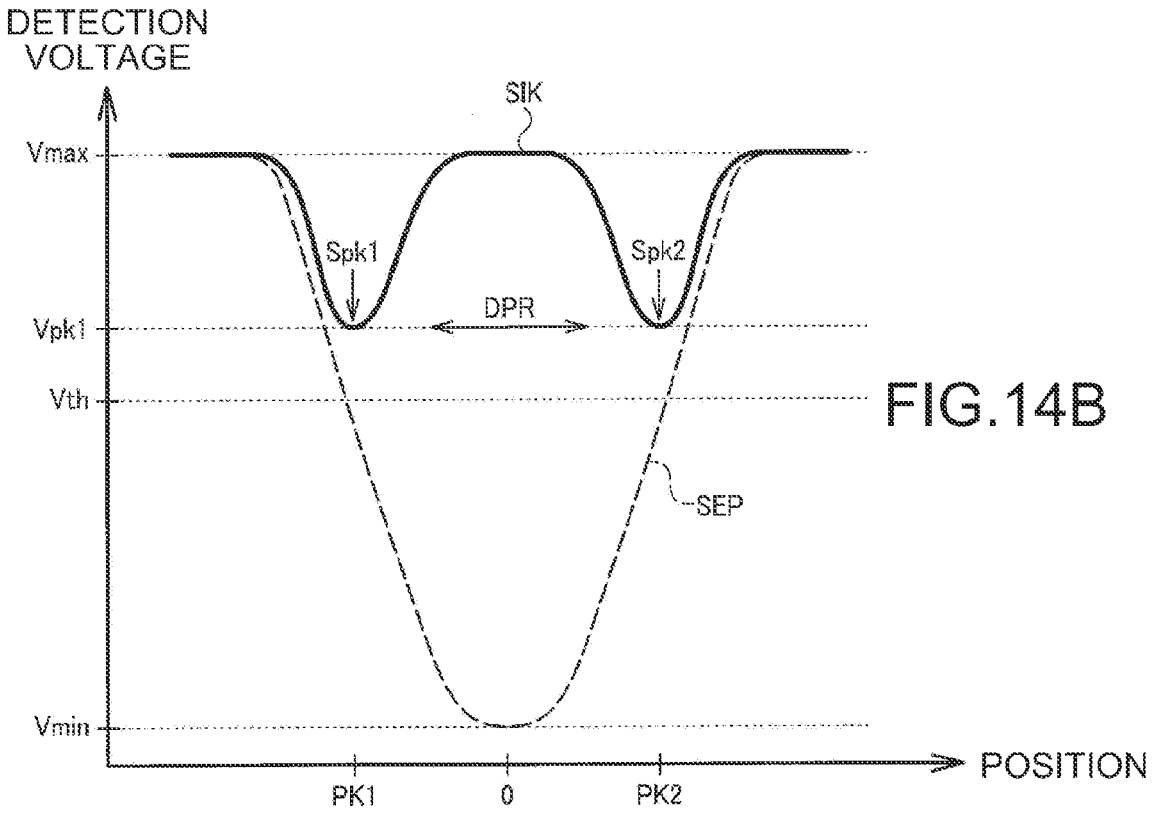
FIG.14B

LIQUID CONSUMING APPARATUS WITH A MOVABLE HOLDER HAVING AN INCLINED FACE

BACKGROUND

1. Technical Field

The present invention relates to a liquid consuming apparatus or the like.

2. Related Art

In an inkjet printer serving as an exemplary liquid consuming apparatus, in general, an ink cartridge, which is a detachable liquid container, is installed. A printer is disclosed that includes an ink cartridge provided with a prism, a holder (carriage) in which the ink cartridge is installed and that is provided with an opening portion at a position facing the prism, and a detection portion having a light-emitting portion and a light-receiving portion, in order to detect the amount of remaining ink in the ink cartridge (e.g., see JP-A-2013-99890).

When the light radiated by the light-emitting portion and entering from the opening portion of the holder is reflected at an inclined face of the prism, the state of reflection differs depending on whether or not the inclined face is in contact with the ink. Using this fact, the amount of remaining ink is detected based on the level of intensity or the like of the reflected light that enters the light-receiving portion. For this reason, for example, the reflected light that is reflected at the holder, a bottom face of the prism, or the like could be noise light and be a factor that hinders accurate detection of the amount of remaining ink in some cases.

In the printer described in JP-A-2013-99890, a light-blocking portion is provided in the opening portion of the holder. When the holder moves in a direction in which the light-emitting portion and the light-receiving portion are arranged, a part of the light radiated from the light-emitting portion is blocked by the light-blocking portion, thereby suppressing reflection at the bottom face of the prism. Furthermore, the light entering the light-blocking portion is caused to be reflected in a direction other than the direction toward the light-receiving portion by forming the bottom face (a face facing the detection portion) of the light-blocking portion into an inclined face inclining in the direction in which the light-emitting portion and the light-receiving portion are arranged. Thus, reduction of the noise light is achieved.

Incidentally, the amount of remaining ink is detected when relative positions of the prism and the detection portion reach a predetermined position (hereinafter referred to also as a detection position). However, the detection position is shifted from an originally-assumed detection position in some cases. For this reason, for example, a reflection portion is provided in the holder. Before the amount of remaining ink is detected, the holder is relatively moved with respect to the detection portion, the position of the reflection portion is detected based on the intensity level or the like of reflected light received by a light-receiving portion, and further, the detection position is corrected.

However, position correction processing using the reflection portion is performed by detecting, using the light-receiving portion, the reflected light that is emitted from a light-emitting portion in the detection portion and reflected at this reflection portion. For this reason, if other light is received by the light-receiving portion, the accuracy of the position correction processing will decrease. "Other light" mentioned here is, for example, ambient light that enters from the outside of the liquid consuming apparatus and light that is emitted from the light-emitting portion and reflected at a portion other than the reflection portion (e.g., reflected at the bottom face of the holder).

SUMMARY

According to some aspects of the invention, a liquid consuming apparatus or the like can be provided that performs accurate position correction processing, as a result of providing an inclined face in an area peripheral to a reflection portion of a holder.

An aspect of the invention relates to a liquid consuming apparatus including: a detection portion having a light-emitting portion and a light-receiving portion; a holder in which a liquid container provided with a prism is attachably and detachably installed, the holder having an opening portion provided at a position facing the prism when the liquid container is installed, and a reflection portion; and a moving portion that relatively moves the holder in a first direction with respect to the detection portion. In the liquid consuming apparatus, a first portion of the holder that is peripheral to the reflection portion in a plan view of the holder as seen from the side of the detection portion has an inclined face that inclines in a second direction intersecting the first direction.

In an aspect of the invention, the inclined face is provided in the first portion peripheral to the reflection portion of the holder, the inclined face inclining in the second direction intersecting the first direction that is the relative moving direction of the holder and the detection portion. For this reason, it is possible to suppress ambient light or reflected light at the holder entering the light-receiving portion and a detected waveform becoming asymmetric, and to accurately perform position correction processing and the like.

In an aspect of the invention, the first portion may have a plurality of steps of inclined faces that incline in the second direction.

With this configuration, the influence of ambient light can be further suppressed by providing the plurality of inclined faces.

In an aspect of the invention, the first portion may have a first to Nth (N is an integer larger than or equal to 2) inclined faces arranged in the second direction, and the distance between the detection portion and the holder at an end point of an ith (i is an integer that satisfies $1 \leq i < N$) inclined face on the side of an i+1th inclined face may be larger than the distance between the detection portion and the holder at an end point of the i+1th inclined face on the side of the ith inclined face.

With this configuration, the distance between the detection portion and the holder can be reduced, and the influence of ambient light can be further suppressed.

In an aspect of the invention, a control portion may be further included that performs processing for correcting a positional relationship between the holder and the detection portion when determining the amount of remaining liquid, based on a detection signal from the detection portion indicating a light reception result of reflected light at the reflection portion.

With this configuration, position correction processing can be performed using the reflected light at the reflection portion.

In an aspect of the invention, a plurality of the liquid containers may be able to be attached to and detached from the holder, the holder may be able to hold the liquid containers, and the holder may have a plurality of the opening portions that are each provided at a position facing each of a plurality of the prisms when the liquid containers are installed. The first portion may be a portion between the reflection portion and a first opening portion among the opening portions.

With this configuration, the inclined face inclining in the second direction can be provided in the portion between the reflection portion and the opening portion.

In an aspect of the invention, a plurality of the liquid containers may be able to be attached to and detached from the holder, the holder may be able to hold the liquid containers, and the holder may have a plurality of the opening portions that are each provided at a position facing each of a plurality of the prisms when the liquid containers are installed. The first portion may be a portion on the side opposite to a first opening portion among the opening portions with respect to the reflection portion.

With this configuration, the inclined face inclining in the second direction can be provided in the portion on the side opposite to the opening portion with respect to the reflection portion.

In an aspect to the invention, a portion between two adjacent opening portions among the opening portions may have an inclined face that inclines in the first direction.

With this configuration, as a result of providing the inclined face between the opening portions, it is possible to accurately determine the amount of remaining liquid or the like.

In an aspect of the invention, a first liquid container and a second liquid container whose capacity is smaller than that of the first liquid container may be able to be attached to and detached from the holder, and the holder may be able to hold the first liquid container and the second liquid container. The reflection portion of the holder may be provided in the holder on the side of the second liquid container.

With this configuration, as a result of separately providing the first liquid container and the reflection portion, it is possible to efficiently suppress the influence of ambient light or the like in determination of the amount of remaining ink or the like.

In an aspect of the invention, the second direction may be a direction orthogonal to the first direction.

With this configuration, the direction of providing the inclined face can be set as the direction orthogonal to the first direction.

BRIEF DESCRIPTION OF THE DRAWINGS

FIGS. 14A and 13B are diagrams illustrating an ink near-end determination method.

DESCRIPTION OF EXEMPLARY EMBODIMENTS

Hereinafter, the present embodiment will be described. Note that the present embodiment described below is not intended to unjustly limit the content of the invention described in the scope of claims. Not all configurations described in the present embodiment are necessarily essential constituent elements of the invention.

1. TECHNIQUE IN PRESENT EMBODIMENT

First, a technique in the present embodiment will be described. As mentioned above, desired light needs to be detected by a detection portion in position correction processing, and signal components generated due to light other than the desired light will be noise that hinders the processing. Specifically, since reflected light at a reflection portion 24 is used in processing as described later using FIGS. 17 and 18, it is conceivable that ambient light and reflected light at a bottom face 21 (a face facing a detection portion 90) of a holder 20 are noise factors.

Firstly, in order to suppress the reflected light at the holder bottom face 21, a technique of realizing this holder bottom face 21 by using a non-reflective member is conceivable. However, even if a non-reflective member is used, the reflected light cannot be reduced to zero, and there is a possibility that noise occurs.

Figure 1C:
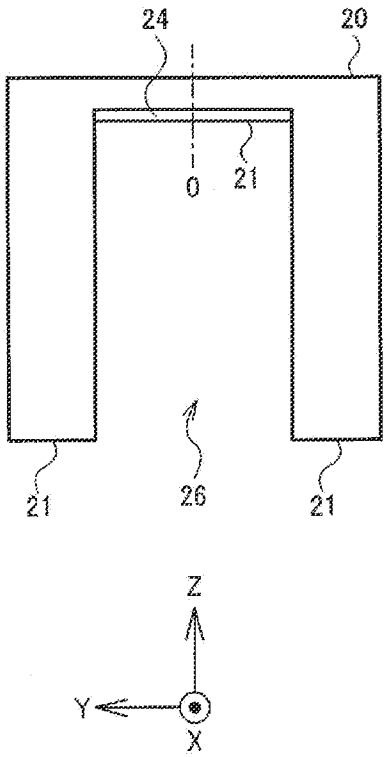
FIGS. 1A to 1C show exemplary shapes of a holder bottom face peripheral to a reflection portion.
Figure 1B:
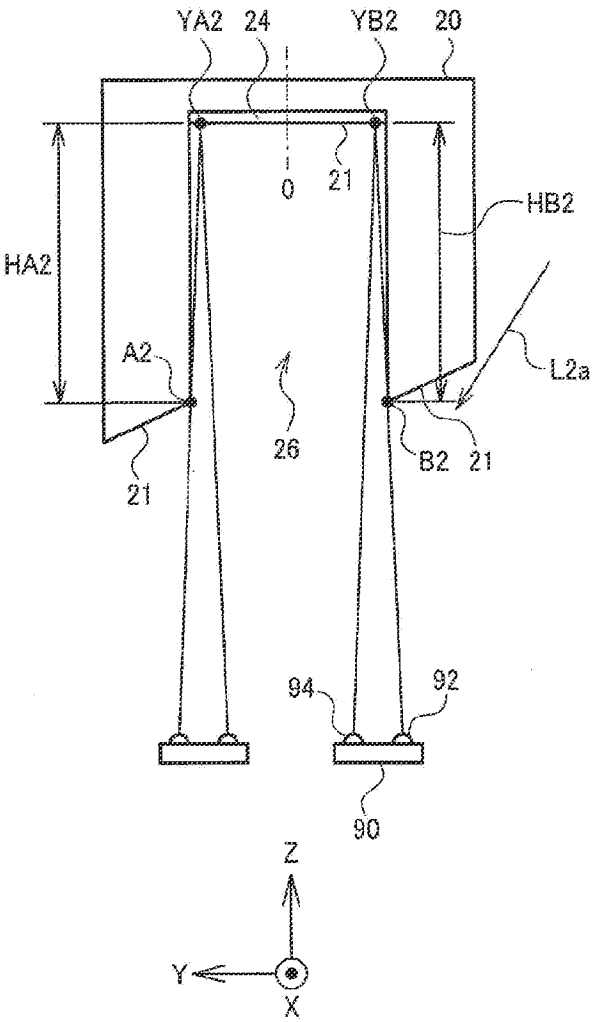
Figure 1A:
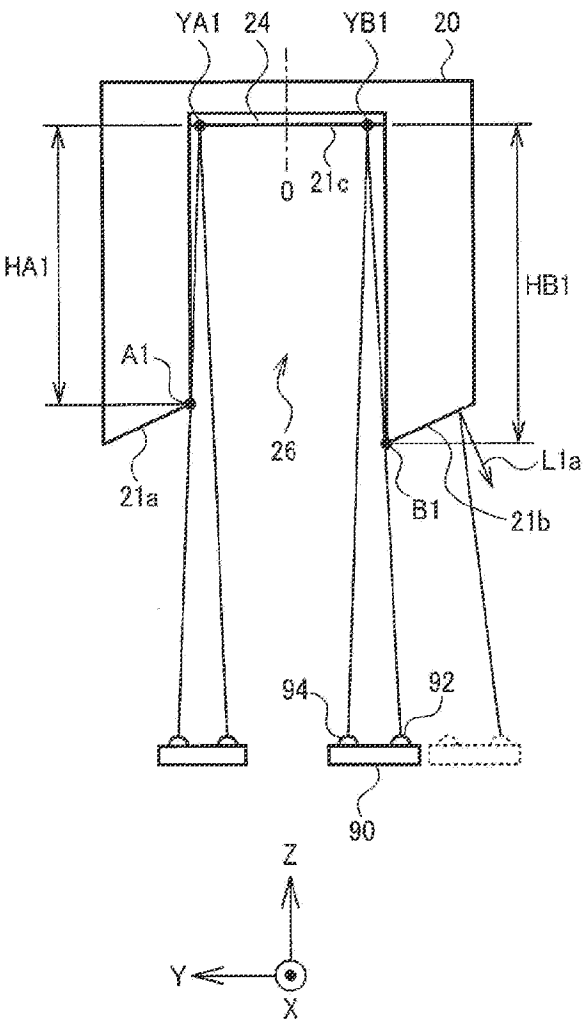
Figure 2A:
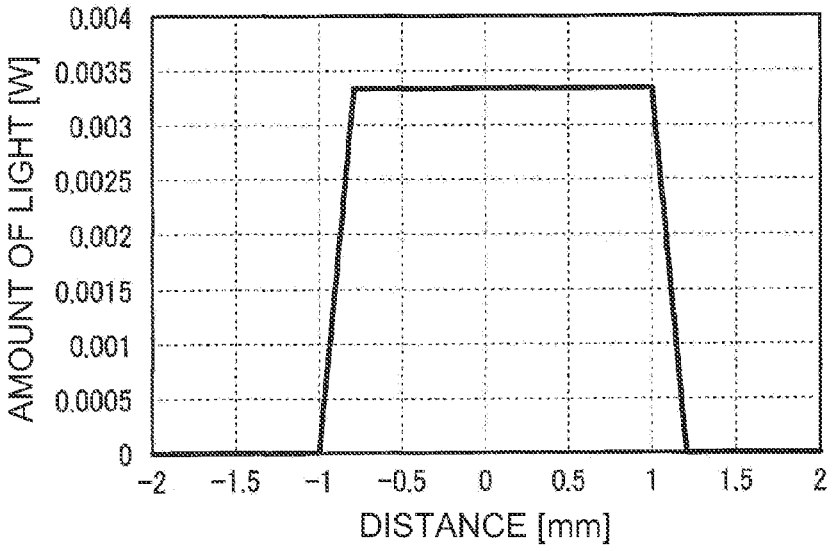
FIGS. 2A to 2C show results of simulation of a detection signal obtained with the respective shapes of the holder bottom face.
Figure 2B:
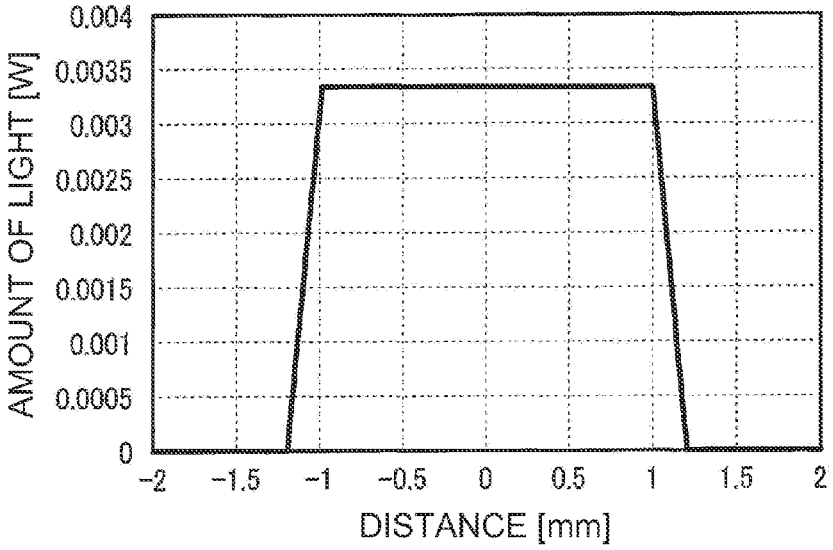
Figure 2C:
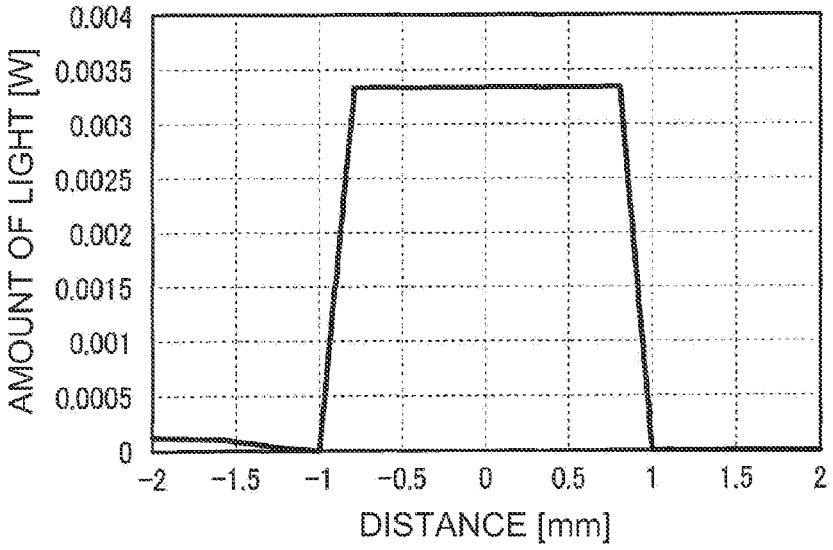

FIGS. 1A to 1C show various shapes of the holder bottom face 21 (specifically, shapes of a reflection portion and a peripheral portion of the holder), and FIGS. 2A to 2C show results of simulation of detection signals at a light-receiving portion when using the holder bottom face of the respective shapes. FIG. 2A shows a simulation result corresponding to the holder bottom face in FIG. 1A. Similarly, FIGS. 2B and 2C correspond to FIGS. 1B and 1C, respectively. As described later using FIG. 4, the Y-axis indicates a main scanning direction HD corresponding to the relative moving direction of the holder and a detection portion, and the X-axis indicates a sub-scanning direction VD. The Z-axis is an axis orthogonal to the Y-axis and the X-axis, and is a vertically upward direction when in a normal use state.

Note that the holder 20 here has a recess portion 26, and the reflection portion 24 is provided in this recess portion 26. Since the bottom face 21 of the holder 20 is a face facing the detection portion 90 as mentioned above, a plurality of faces are included in the bottom face 21 in the holder 20 having such a shape. For example, a face 21*a* including a point A1 and a face 21*b* having a point B1 in FIG. 1A are included in the bottom face 21 of the holder 20. The bottom face 21 is not limited thereto, and a bottom face 21*c* of the recess portion 26 in which the reflection portion 24 is provided is also included in the bottom face 21 of the holder 20. Note that, in FIG. 1B and subsequent drawings, the same reference numeral (21) will be given to all of the plurality of faces included in the bottom face 21 of the holder 20, unless otherwise stated.

Here, it is assumed that the light-emitting portion ideally emits light, and laser light is used in the simulation. Even if a non-reflective member is used as the holder bottom face 21, if this bottom face 21 is arranged substantially parallel with the face in which the light-emitting portion 92 and the light-receiving portion 94 are arranged as shown in FIG. 1C, the influence of the reflected light at the holder bottom face 21 cannot be sufficiently suppressed. Specifically, in a range smaller than or equal to −1 on the horizontal axis in FIG. 2C, a signal is detected that causes noise in the position correction processing. Note that the horizontal axes in FIGS. 2A to 2C correspond to the main scanning direction (Y-axis), and the vertical axes correspond to the signal intensity. The origin (0) of the horizontal axis indicates a relative positional relationship in which the center position between the light-emitting portion and the light-receiving portion coincides with the center position of the reflection portion (reflecting plate) in the main scanning direction.

In contrast, the influence of the reflected light at the holder bottom face 21 can be suppressed by providing an inclined face in the holder bottom face 21. For example, when employing the shape of the holder 20 shown in FIG. 1A, the bottom face has inclined faces inclining in the main scanning direction (Y-axis direction) (i.e., faces whose distance in the Z-axis direction from the face in which the light-receiving portion and the light-emitting portion are arranged monotonously increases or decreases along the Y-axis). For this reason, light L1*a* emitted from the light-emitting portion 92 is reflected at the holder bottom face 21 in the direction indicated in FIG. 1A, and is unlikely to be detected by the light-receiving portion 94. As a result, the influence of noise caused by the reflected light at the holder bottom face 21 can be suppressed as shown in FIG. 2A.

However, as can be found by comparing the points A1 and B1 in FIG. 1A, the height of the holder 20 (i.e., the length thereof in the Z-axis direction relative to the reflection portion) differs in the +Y direction and the −Y direction of the reflection portion. For example, when assuming the height as the distance in the Z-axis direction from a reference point, which is on the surface of the reflection portion 24, the heights of the points A1 and B1 are HA1 and HB1, respectively, as shown in FIG. 1A. In the case of FIG. 1A, HA1<H1B.

For this reason, in the +Y direction, the light that is radiated from the light-emitting portion 92, reflected at the reflection portion 24, and received by the light-receiving portion 94 is blocked at the point A1, and a position YA1 is the boundary in the main scanning direction that determines whether or not the reflected light from the reflection portion 24 can be detected by the light-receiving portion 94. In other words, if the position at which light is reflected at the reflection portion 24 moves from YA1 further in the +y direction, the reflected light is blocked by the holder 20 (particularly, a face in an XZ plane including the point A1) and cannot be received by the light-receiving portion 94.

Meanwhile, in the −y direction, since the aforementioned light is blocked at B1 that is higher than A1, the boundary in the main scanning direction that determines whether or not the light can be detected is considered to be a position YB1. Due to the difference in the height between A1 and B1, the distance from the center position of the reflection portion 24 to YB1 is smaller than the distance from the center portion of the reflection portion 24 to YA1.

Consequently, the detection signal corresponding to FIG. 1A has an asymmetric shape with respect to the origin of the horizontal axis, as shown in FIG. 2A. Since position correction is performed by finding peak positions as described later using FIG. 18, the center position of the reflection portion 24 cannot be appropriately determined if the signal in FIG. 2A is used.

In contrast, a technique is conceivable of resolving an asymmetric detection signal by making the height of the holder 20 uniform in the +Y direction and the −Y direction, as shown in FIG. 1B. With the shape in FIG. 1B, since the heights of points A2 and B2 relative to the reflection portion 24 are equal (HA2=HB2), the distances from the center position of the reflection portion 24 to YA2 and YB2 are equal. As a result, a left-right symmetric signal waveform is obtained as shown in FIG. 2B, and accordingly the center position of the reflection portion 24 can be detected.

However, ambient light is not considered in the simulation in FIG. 2B. For example, when the cover of the printer is open, light from the outside such as sunlight or illumination light enters, as ambient light, the inside of the apparatus. This ambient light is, of course, light that is not assumed to be detected in the processing, and therefore becomes noise that reduces the processing accuracy. In the shape in FIG. 1B, the height of the holder bottom face 21 in the −Y direction is lower than in FIG. 1A in order to make the heights of the points A2 and B2 uniform. For this reason, depending on the position at which the reflection portion of the holder is arranged, there is a possibility that ambient light denoted by L2*a* in FIG. 1B enters the light-receiving portion.

Figure 4:
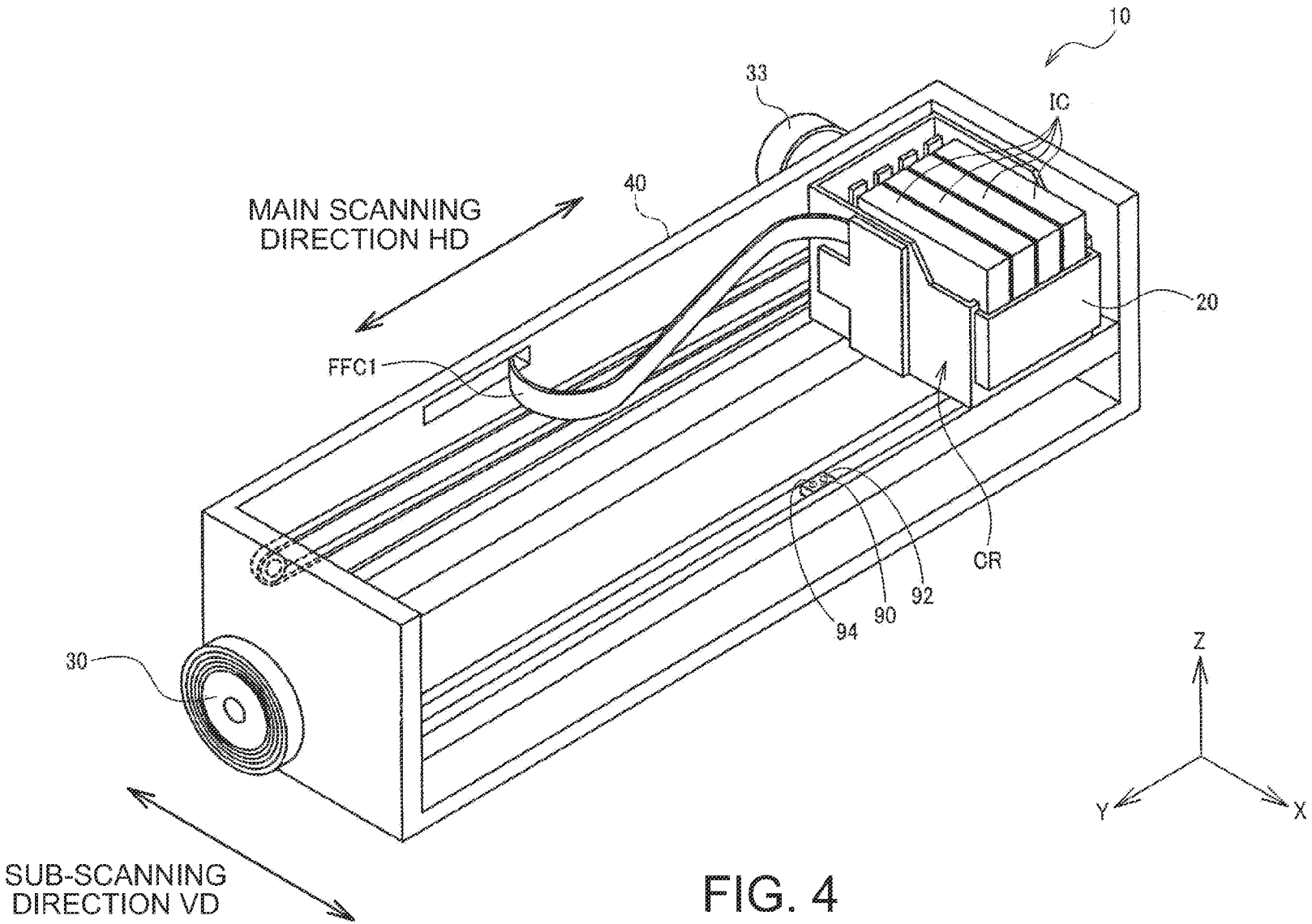
FIG. 4 is a perspective view showing a main part of a printer according to the present embodiment.

That is to say, the shape in FIG. 1B cannot be considered to be preferable either, in terms of suppression of the influence of ambient light. For the above-described reason, the present inventor proposes a technique of providing, in the holder bottom face 21, an inclined face inclining in a direction intersecting the main scanning direction. Specifically, as shown in FIG. 4, a liquid consuming apparatus according to the present embodiment includes a detection portion 90 having a light-emitting portion 92 and a light-receiving portion 94, a holder 20 in which liquid containers (corresponding to ink cartridges IC) each provided with a prism (a prism 170 in FIG. 8) are attachably and detachably installed, the holder 20 having a reflection portion 24 and opening portions 22 provided at positions facing the prisms when the liquid containers are installed, and a moving portion (corresponding to a carriage motor 33) that relatively moves the holder 20 in a first direction with respect to the detection portion 90. A first portion (e.g., a portion indicated by oblique lines in FIG. 9A) of the holder 20 that is peripheral to the reflection portion 24 in a plan view of the holder 20 as seen from the side of the detection portion 90 has inclined faces that incline in a second direction intersecting the first direction.

Figure 3A:
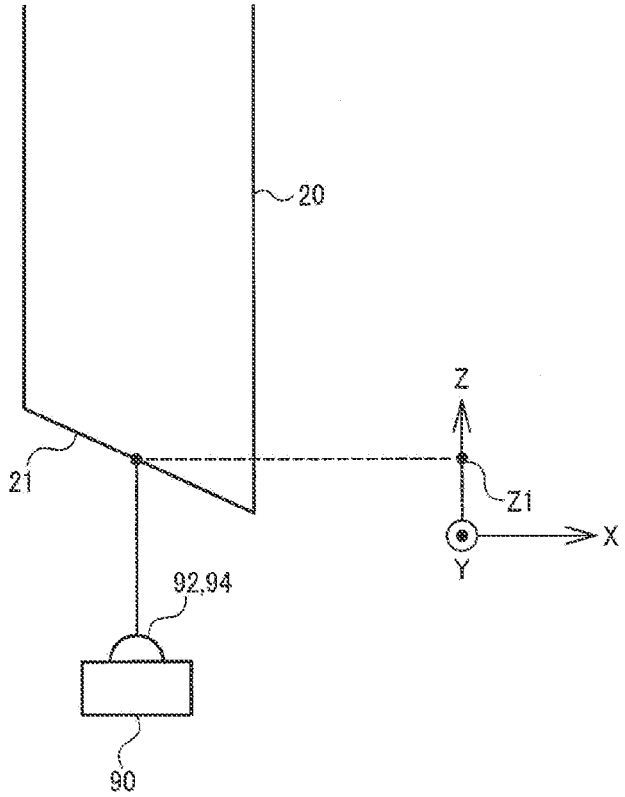
FIGS. 3A and 3B show an exemplary configuration of a holder according to the present embodiment.
Figure 3B:
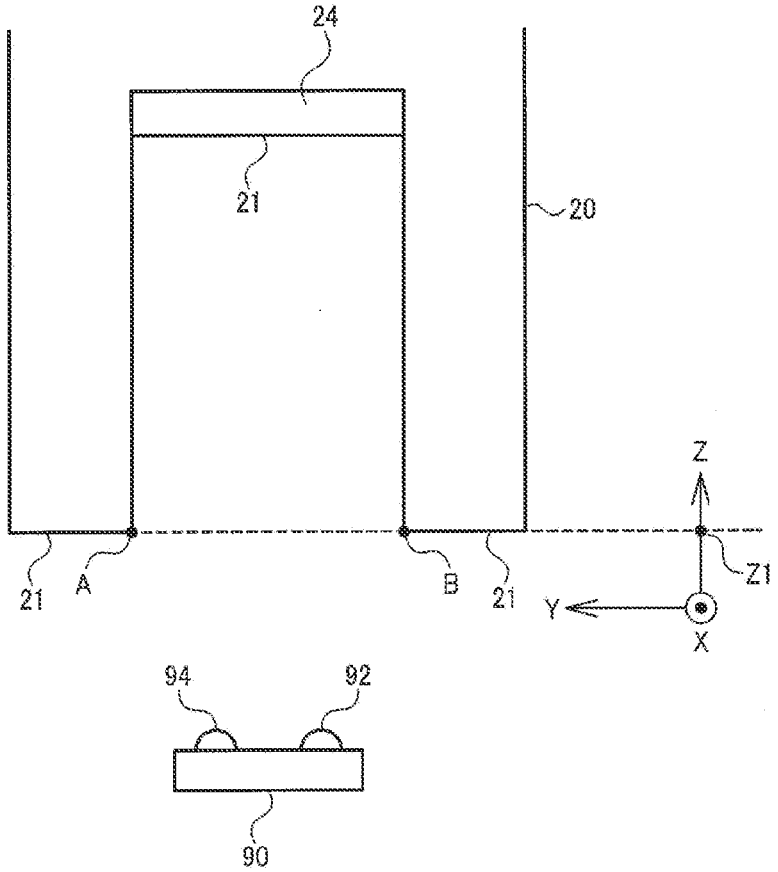

Specifically, the second direction may be a direction orthogonal to the first direction, and assuming that the first direction is the main scanning direction HD (Y-axis), the second direction is the sub-scanning direction VD (X-axis). In this case, the shape of the holder 20 peripheral to the reflection portion 24 is as shown in FIGS. 3A and 3B. FIG. 3A shows the shape of the holder 20 in an XZ plane, and FIG. 3B shows the shape of the holder 20 in a YZ plane.

Here, an inclined face that inclines in a predetermined direction refers to a face whose position in a direction intersecting the predetermined direction monotonously increases or monotonously decreases when the position in the predetermined direction constantly changes. In the example in FIG. 3A, the inclined face is a face whose the position in a third direction (Z-axis) intersecting the second direction monotonously changes from the +Z direction toward the −Z direction, in the positive direction of the second direction (X-axis).

With this configuration, it is possible to provide the inclined faces in the bottom face 21 of the holder 20 while causing the heights thereof relative to the reflection portion, i.e., the Z-axis coordinate values thereof to correspond to each other (narrowly defined, to be the same) on one side and the other side in the Y-axis direction with respect to the reflection portion 24. That is to say, two portions of the holder bottom face peripheral to the reflection portion in the Y-axis direction are provided with inclined faces that incline in the X-axis direction so as to be aligned with the same direction, and accordingly, the height of the recess portion from the reflection portion to the holder bottom face can be made uniform. For example, assuming that a Z-axis coordinate value of the holder bottom face 21 at a position facing the light-emitting portion 92 and the light-receiving portion 94 of the detection portion 90 is z1, as shown in FIG. 3A, both Z-axis coordinate values of the points A and B in the YZ plane including the light-emitting portion 92 and the light-receiving portion 94 are z1, as shown in FIG. 3B. Since the holder 20 thereby have the inclined faces, the influence of reflected light due to the holder 20 can be suppressed in the position correction processing, unlike in the example in FIG. 1C. Also, since the heights of the points A and B are equal to each other, the detection signal do not become asymmetric with respect to the center of the reflection portion 24 in the Y-axis direction, unlike in the example in FIG. 1A. That is to say, with the liquid consuming apparatus in the present embodiment, the position correction processing can be accurately executed.

Hereinafter, a liquid consuming apparatus in the present embodiment will be described in detail. A basic configuration of the liquid consuming apparatus and an exemplary configuration of the ink cartridges will be described first, and subsequently an exemplary configuration of the holder will be described. Furthermore, a description will be given of a technique of determining the amount of remaining liquid (ink near-end detection technique) and a position correction technique, and lastly of modifications.

2. BASIC CONFIGURATION OF PRINTER, INK CARTRIDGES

Figure 5:
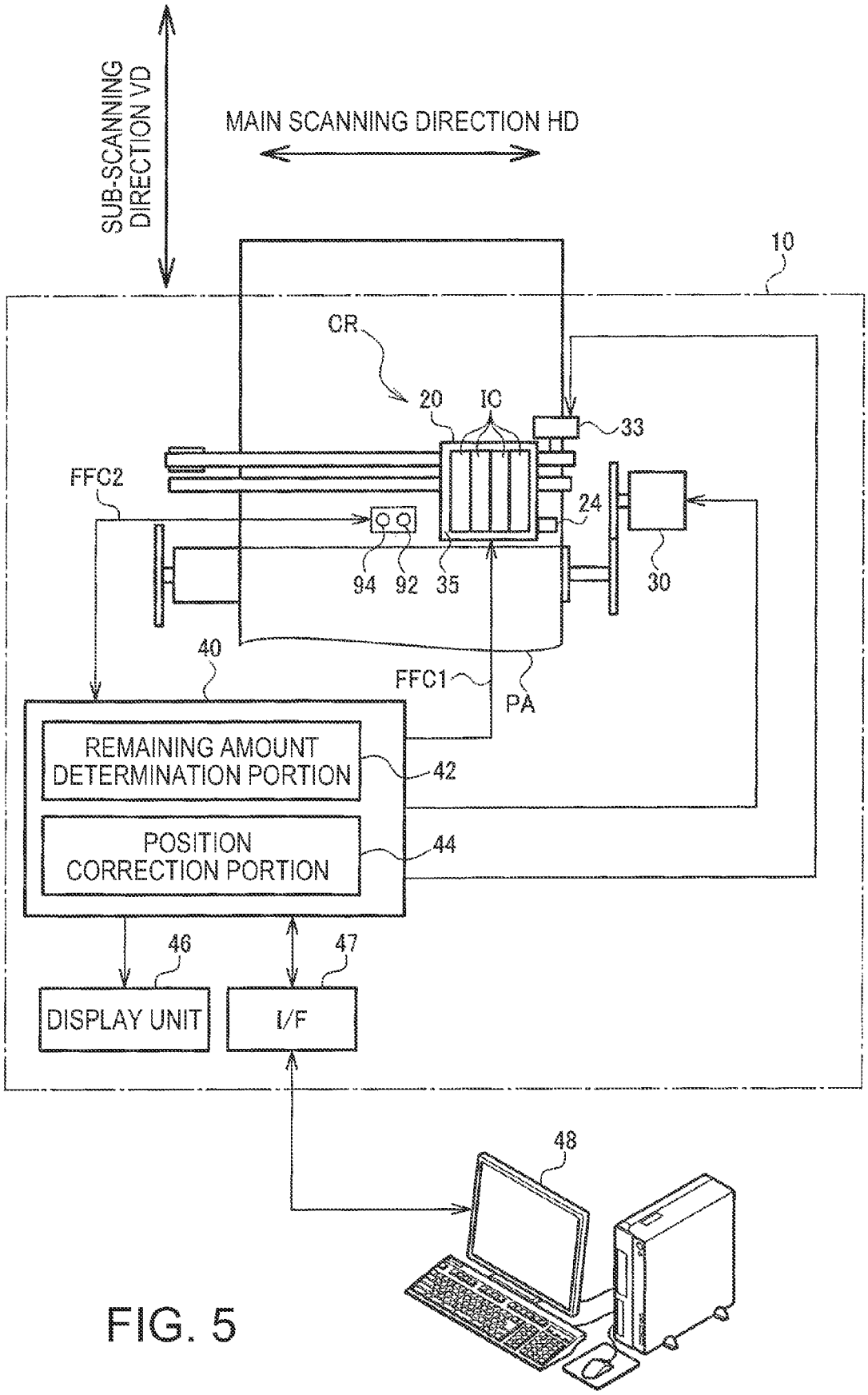
FIG. 5 is a schematic block diagram of the printer according to the present embodiment.

A basic configuration of a printer serving as a liquid consuming apparatus according to the present embodiment will be described with reference to FIGS. 4 and 5. FIG. 4 is a perspective view showing a main part of the printer according to the present embodiment. FIG. 5 is a schematic block diagram of the printer according to the present embodiment.

FIG. 4 shows a Y-axis direction serving as a first direction, an X-axis direction that is perpendicular to the Y-axis direction and serves as a second direction, and a Z-axis direction that is perpendicular to the X-axis direction and the Y-axis direction and serves as the third direction. In the present embodiment, in the posture of a printer 10 when in use, the Z-axis direction (+Z direction and −Z direction) is the vertical direction, and a +X direction is the direction toward the front of the printer 10. The Y-axis direction (+Y direction and −Y direction) is a main scanning direction HD of the printer 10, and the X-axis direction (+X direction and −X direction) is a sub-scanning direction VD of the printer 10.

As shown in FIG. 4, the printer 10 includes a plurality of ink cartridges IC each serving as a liquid containing portion, a carriage CR including a holder 20, a paper feed motor 30, a carriage motor 33 serving as a moving portion, a cable FFC1, a detection portion 90, and a control unit 40. For example, cyan ink, magenta ink, yellow ink, and black ink are contained in the respective ink cartridges IC. The ink cartridges IC are installed in the holder 20. Note that the holder 20 may be formed as a member integrated with the carriage CR, or may be formed as a separate member and incorporated in the carriage CR.

As shown in FIG. 5, the carriage CR includes the holder 20 and a print head 35. The carriage CR moves back and forth above a print medium PA in the main scanning direction HD, by being driven by the carriage motor 33. The paper feed motor 30 conveys the print medium PA in the sub-scanning direction VD. The print head 35 is carried in the carriage CR, and discharges ink supplied from the ink cartridges IC. Note that, in FIGS. 4 and 5, the carriage CR is located at its home position.

The detection portion 90 outputs a signal for detecting the amount of remaining ink in the ink cartridges IC to the control unit 40. The detection portion 90 includes a light-emitting portion 92 (light-emitting device) that radiates light toward a prism 170 (see FIG. 8) in each ink cartridge IC, and a light-receiving portion 94 (light-receiving device) that receives reflected light from the prism 170 and converts it into an electric signal.

Figure 6:
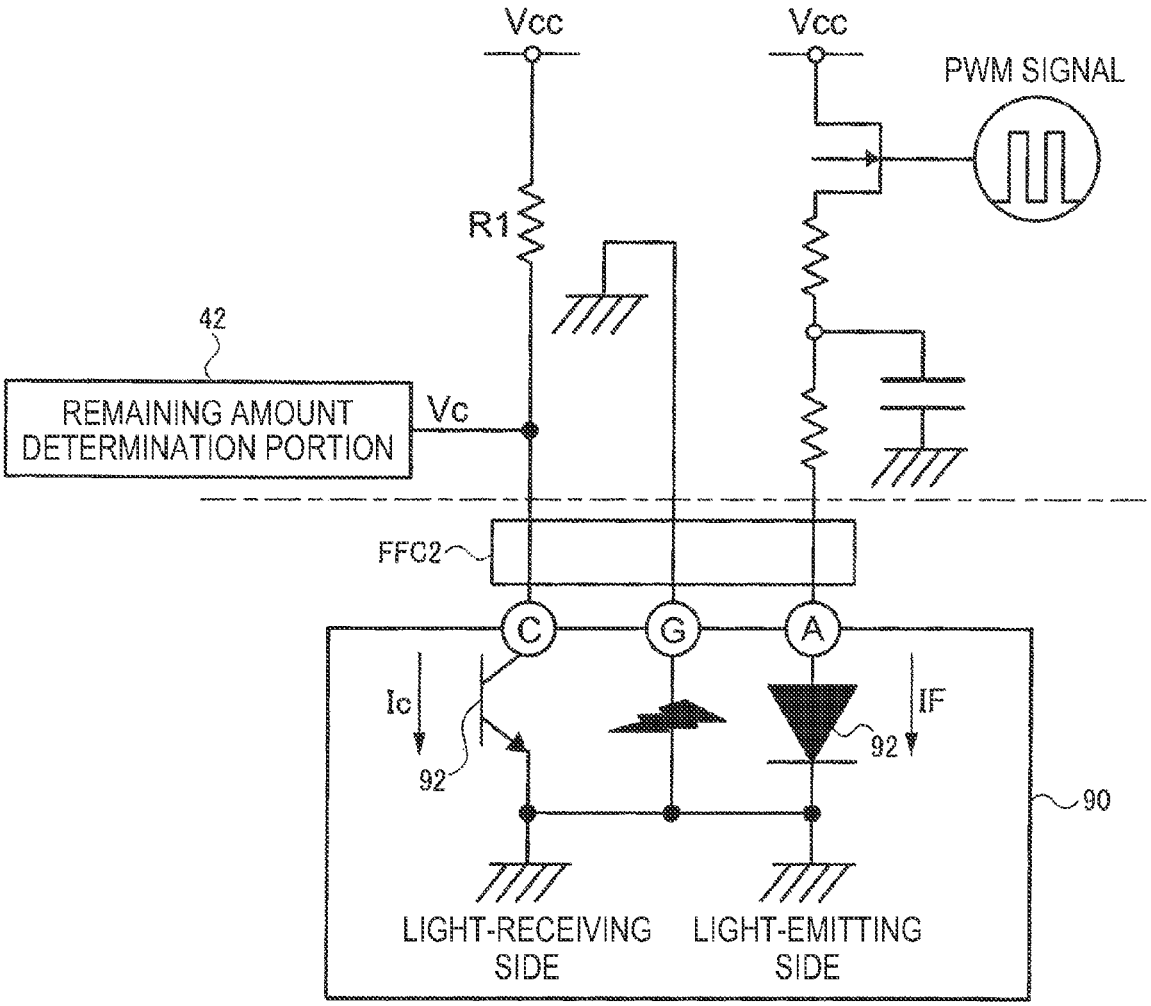
FIG. 6 is an illustrative diagram showing an electric configuration of a detection portion.

FIG. 6 is an illustrative diagram showing an electric configuration of the detection portion. For example, the detection portion 90 includes an LED (Light Emitting Diode) as the light-emitting portion 92 (light-emitting device), and includes a phototransistor as the light-receiving portion 94 (light-receiving device). An emitter terminal of the light-receiving portion 94 is grounded, and a collector terminal thereof is connected to power supply potential Vcc via a resistor R1. Electric potential between the resistor R1 and the collector terminal is input, as output voltage Vc (detection voltage) of the detection portion 90, to a remaining amount determination portion 42, details of which will be described later.

The amount of the light radiated by the light-emitting portion 92 is set by a duty ratio (ratio between on-time and off-time) of a PWM (Pulse Width Modulation) signal applied to the light-emitting portion 92 being adjusted by the control unit 40. When the radiated light that is radiated from the light-emitting portion 92 is reflected at the prism 170 in each ink cartridge IC and the reflected light is received by the light-receiving portion 94, the output voltage Vc corresponding to the amount of the received light is input as an output signal to the remaining amount determination portion 42. In the present embodiment, as the amount of the light to be received by the light-receiving portion 94 is larger, the output voltage Vc to be output from the detection portion 90 is smaller.

Figure 7:
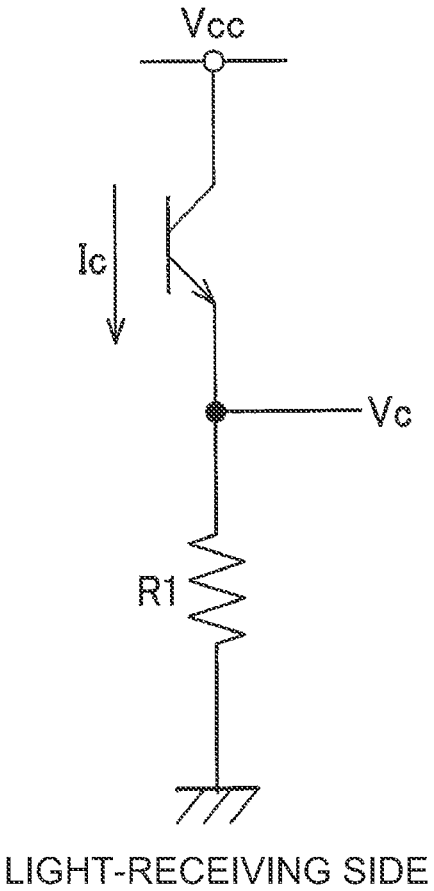
FIG. 7 shows another exemplary configuration of a light-receiving portion.

However, the configuration of the light-receiving portion 94 is not limited to that in FIG. 6, and a relationship between the amount of light received by the light-receiving portion 94 and a detection signal of the detection portion 90 (the light-receiving portion 94) is not limited to the above-described relationship either. For example, with the configuration of the light-receiving portion 94 shown in FIG. 7, the larger the amount of light received by the light-receiving portion 94 is and the larger the amount of generated current is, the larger the difference between the output voltage Vc and a ground potential VSS is. That is to say, the larger the amount of light received by the light-receiving portion 94 is, the higher the output voltage Vc output from the detection portion 90 is.

Considering that the detection portion 90 is originally for detecting the amount of incident light and the light-receiving portion 94 is a device that converts light into current, the output of the detection portion 90 may be essentially considered to be the amount of current generated at the light-receiving portion 94. Considering it to be the amount of current, a relationship is established in which the stronger the incident light is, the larger the output current is. Accordingly, the amount of incident light can be determined regardless of the configuration. The following is a description of an example in which the configuration of the light-receiving portion 94 shown in FIG. 6 is employed, and it is accordingly assumed that the larger the amount of incident light is, the larger the amount of generated current is and the lower the output voltage Vc is. However, "the output voltage being low (high)" in the following description can be essentially considered to be "the amount of generated current being large (small)", and the form of the output signal that the amount of current is detected in can be modified in various manners.

As shown in FIGS. 4 and 5, the light-emitting portion 92 and the light-receiving portion 94 provided in the detection portion 90 are arranged so as to be aligned with the main scanning direction HD (Y-axis direction) in which the holder 20 moves. The holder 20 is relatively moved with respect to the detection portion 90 in the main scanning direction HD by the carriage motor 33. The light-emitting portion 92 and the light-receiving portion 94 are arranged so as to face the prism 170 in each ink cartridge IC via a corresponding opening portion 22 (see FIG. 9B) of the holder 20 when the holder 20 is moved by the carriage motor 33 and is located above the detection portion 90. A face of the detection portion 90 in which the light-emitting portion 92 and the light-receiving portion 94 are arranged is arranged substantially parallel with the prism bottom face.

The control unit 40 has the remaining amount determination portion 42 and a position correction portion 44. A display unit 46 on which an operation state or the like of the printer 10 is displayed is connected to the control unit 40. A computer 48 is connected to the control unit 40 via an interface (I/F) 47. Furthermore, the carriage CR is connected to the control unit 40 via the cable FFC1, and the detection portion 90 is connected to the control unit 40 via a cable FFC2.

The control unit 40 includes a CPU, a ROM, a RAM, and the like (not shown). The CPU functions as the remaining amount determination portion 42 and the position correction portion 44 by deploying control programs stored in advance in the ROM onto the RAM and executing it. The control unit 40 also controls printing on the print medium PA by controlling the paper feed motor 30, the carriage motor 33, and the print head 35.

The remaining amount determination portion 42 determines, using the detection portion 90 and the prism 170, the amount of remaining ink in each ink cartridge IC. The remaining amount determination portion 42 acquires the output voltage Vc (detection voltage) at the time when the prism 170 is located at a predetermined position (detection position) with respect to the detection portion 90, from the detection portion 90 via the cable FFC2. The remaining amount determination portion 42 then determines whether or not the amount of the ink in each ink cartridge IC has become smaller than or equal to a predetermined amount, based on the acquired output voltage Vc and a predetermined threshold value. The state where the amount of remaining ink has become smaller than or equal to the predetermined amount will be hereinafter referred to also as an "ink near-end" state.

Regarding the ink cartridge IC that is in the ink near-end state according to the determination, the control unit 40 outputs an instruction to display an alarm for indicating ink replacement to the display unit 46 of the printer 10 and a display unit of the computer 48, and thus prompts a user to replace the ink cartridge IC. The control unit 40 determines that the ink cartridge IC is empty when a predetermined amount of the ink is consumed after it is determined that the ink cartridge IC is in the ink near-end state. The control unit 40 may determine that the ink cartridge IC is empty when determining that the ink cartridge IC is in the ink near-end state. If the control unit 40 determines that the ink cartridge IC is empty, the control unit 40 does not execute printing until the ink cartridge IC is replaced.

The position correction portion 44 corrects information of the position of each prism 170 with respect to the detection portion 90 in the main scanning direction HD, based on the detection voltage (output voltage Vc) from the detection portion 90. If the actual relative position of the prism 170 with respect to the detection portion 90 is shifted from the designed relative position thereof, the accuracy of the ink near-end determination for the ink cartridges IC decreases. For this reason, the relative position of the holder 20 (prism 170) with respect to the detection portion 90 at the time when the ink near-end determination is performed is corrected based on the reflected light from the reflection portion 24. The details will be described later. Also, peak detection may be performed on the detection voltage from the detection portion 90 for each ink cartridge IC, and the relative position may be corrected using the detected peak position as well.

The position of the carriage CR (holder 20) is perceived based on the output of a rotary encoder carried in the carriage motor 33. That is to say, the rotary encoder outputs a count value corresponding to the amount of movement from the home position of the carriage CR, which is regarded as a reference position, for example. A predetermined count value of the rotary encoder corresponds to the center position of the prism 170 in each ink cartridge IC. Prior to the position correction, the count value corresponding to each position is mechanically set based on a design value, and is stored in an EEPROM (nonvolatile memory) in the control unit 40, for example. The position correction portion 44 corrects the count value corresponding to each position by performing position correction processing and writes the corrected count value in the RAM and the EEPROM in the control unit 40, and the remaining amount determination portion determines, based thereon, the amount of remaining ink in the ink cartridges.

Figure 8:
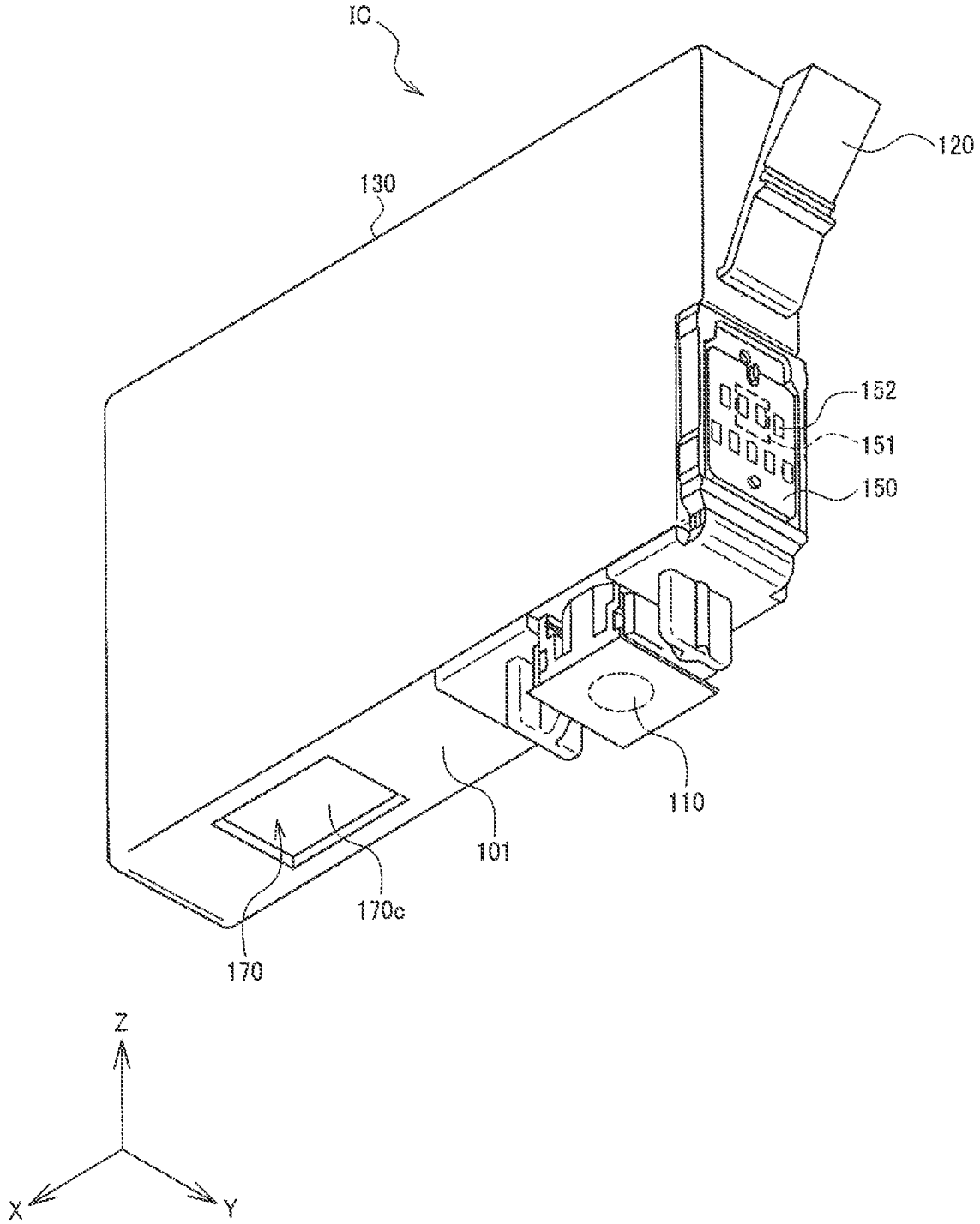
FIG. 8 is a perspective view of an ink cartridge.

FIG. 8 is a perspective view of an ink cartridge. Each ink cartridge IC includes a substantially rectangular-parallelepiped ink containing chamber 130 that contains ink, a circuit board 150, and a lever 120 for attaching and detaching the ink cartridge IC to/from the holder 20.

The prism 170, which has a rectangular equilateral triangle column shape, is arranged in a bottom portion (a face in the −Z direction) of the ink containing chamber 130. A bottom face 170*c* of the prism 170 that is a face facing the detection portion 90 is an incident face that the radiated light from the light-emitting portion 92 (see FIG. 5) enters, and is exposed from a bottom face 101 of the ink cartridge IC that is a face on the side in the −Z direction.

An ink supply port 110, into which an ink receiving needle (not shown) provided in the holder 20 is inserted when the ink cartridge IC is installed in the holder 20, is formed in the bottom face 101 of the ink cartridge IC. In a state where the ink cartridge IC is unused, the ink supply port 110 is sealed by a film. Upon the ink cartridge IC being installed from above into the holder 20 (see FIG. 4), the film is torn by the ink receiving needle, and the ink is supplied from the ink containing chamber 130 to the print head 35 through the ink supply port 110.

A storage device 151 for recording information related to the ink cartridge IC is attached to a back face of the circuit board 150. A plurality of terminals 152 that are electrically connected to the storage device 151 are arranged in a front face of the circuit board 150. When the ink cartridge IC is installed in the holder 20, the terminals 152 come into electric contact with a plurality of body terminals (not shown) provided in the holder 20.

These body terminals are electrically connected to the control unit 40 via the cable FFC1. Thus, when the ink cartridge IC is installed in the holder 20, the control unit 40 is electrically connected to the storage device 151, and can read and write data from/to the storage device 151. As the storage device 151, for example, a nonvolatile memory such as an EEPROM can be used.

3. CONFIGURATION OF HOLDER

Figure 9A:
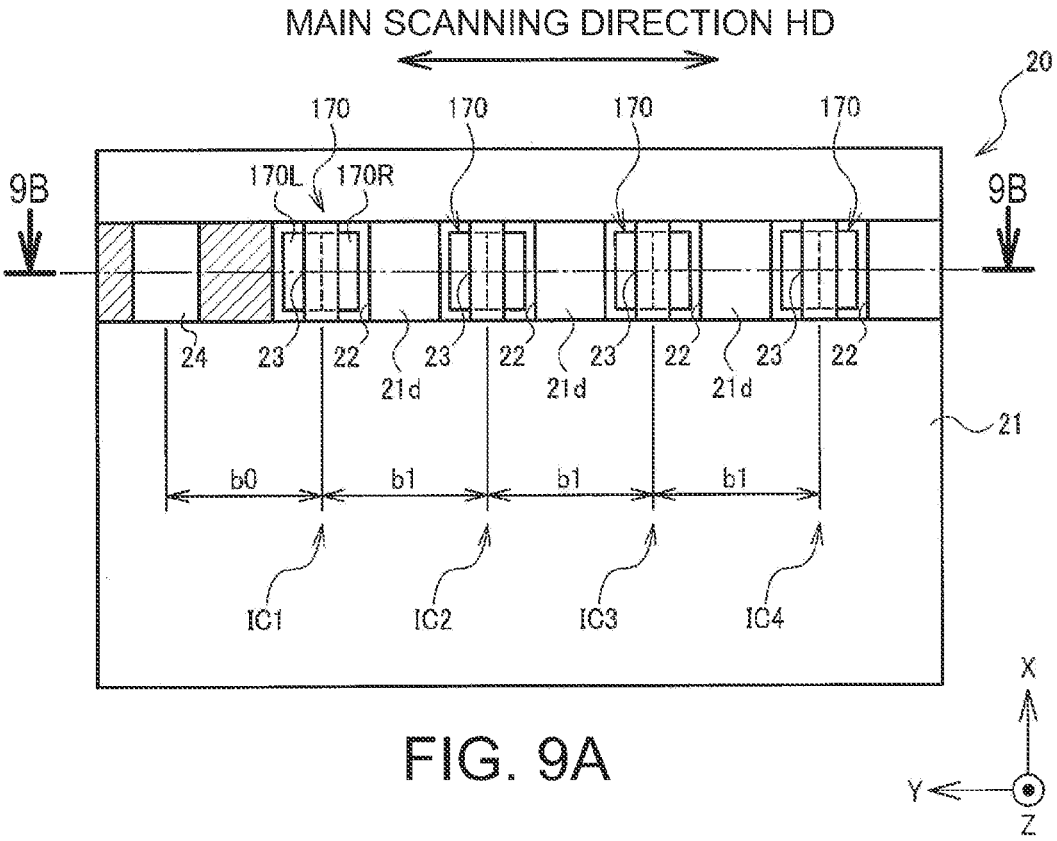
FIGS. 9A and 9B are diagrams illustrating a detailed configuration of the holder according to the present embodiment.
Figure 9B:
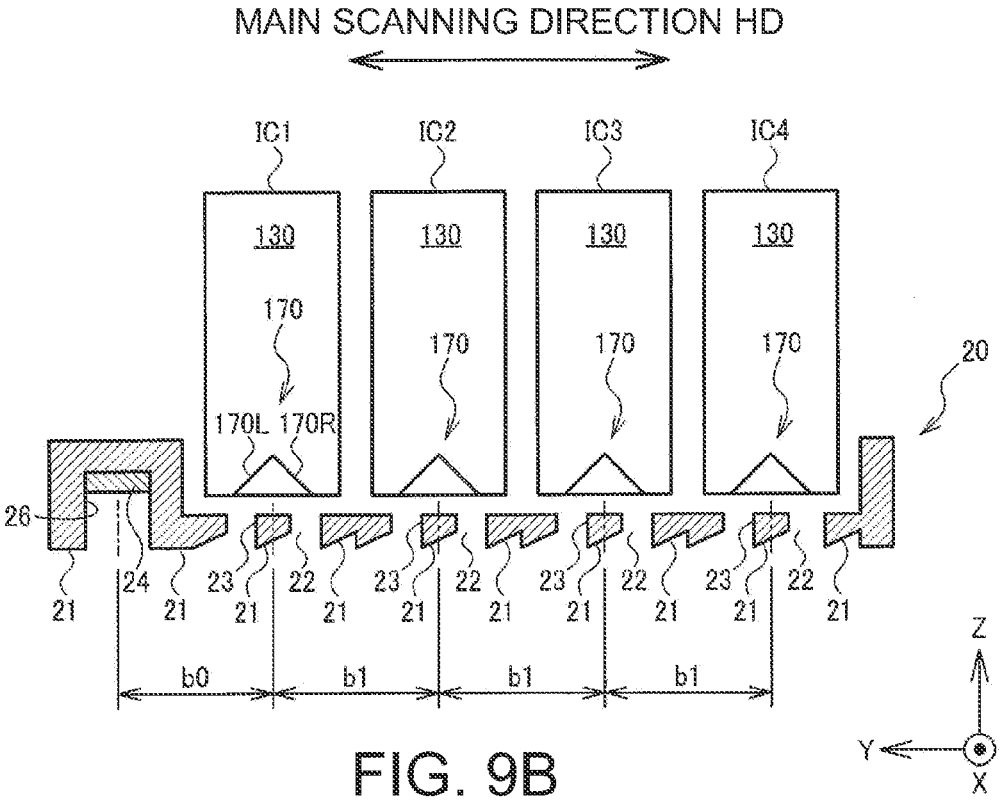

FIGS. 9A and 9B are diagrams illustrating a configuration of the holder according to the present embodiment. FIG. 9A is a schematic view of a bottom face (bottom portion) of the holder 20 as seen from the side of the detection portion 90. FIG. 9B is a schematic view of a YZ cross-section of the holder 20 in which the ink cartridges IC are installed. FIG. 9B corresponds to a cross-sectional view taken along line 9B-9B in FIG. 9A. As shown in FIGS. 9A and 9B, a portion of the bottom face 21 of the holder 20 that corresponds to the prism and faces the detection portion 90 has an inclined face 21*d* that inclines in the main scanning direction HD (Y-axis direction).

The bottom face 21 of the holder 20 also has, for example, four opening portions 22 that are provided so as to be aligned with the main scanning direction HD. Each opening portion 22 is arranged so as to be sandwiched between portions of the inclined face 21*d* in the main scanning direction HD. In other words, the inclined face 21*d* is arranged between the opening portions 22 that are adjacent to each other in the main scanning direction HD, and on both outer sides of the four opening portions 22 in the main scanning direction HD. Four ink cartridges IC1 to IC4 are installed in the holder 20 at positions corresponding to the respective opening portions 22.

A light-blocking portion 23 that blocks the radiated light from the light-emitting portion 92 is provided at the center of each opening portion 22 so as to cover a part of the opening portion 22. The center of each opening portion 22 is a position corresponding to the edge line (center) of the prism 170 when the corresponding ink cartridge IC is installed in the holder 20, at the time of designing the printer and the ink cartridge. The center positions of two adjacent opening portions 22 are separate from each other by the distance b1. Accordingly, the center positions of adjacent light-blocking portions 23 are separate from each other by the distance b1. This distance b1 is mechanically set based on a design value.

The light-blocking portions 23 are provided in the sub-scanning direction VD (X-axis direction) intersecting the main scanning direction HD (Y-axis direction), and each divide the corresponding opening portion 22 of the holder 20 into two parts, namely an opening portion 22*a* and an opening portion 22*b* (see later-described FIGS. 13A and 13B). Each light-blocking portion 23 is arranged at a position facing the edge line of the corresponding prism 170. At the detection position when performing the ink near-end determination, the opening portion 22*a*, which is a part of each opening portion 22 divided into two parts by the corresponding light-blocking portion 23, is located at a position at which the light-emitting portion 92 and the inclined face 170R face each other, and the opening portion 22*b*, which is the other part of each opening portion 22, is located at a position at which the light-receiving portion 94 and the inclined face 170L face each other.

An inclined face that inclines in the main scanning direction HD (Y-axis direction) is provided in each light-blocking portion 23 on the side of the detection portion 90. The light-blocking portions 23 are made of a light-absorbing material, such as black-colored polystyrene, for example. In the present embodiment, the light-blocking portions 23 are made of the same material as that of the holder 20, and are formed integrally therewith. In this case, a face of the light-blocking portion 23 that faces the detection portion 90 is included in the bottom face 21 of the holder 20. However, the material of the light-blocking portions 23 is not limited to the aforementioned material, and any material may be applied that can suppress the reflected light entering the light-receiving portion 94. A configuration may be employed in which the light-blocking portion 23 is formed as a body separate from the holder 20 and is attached to the holder 20, and in this case, the face of the light-blocking portion 23 does not constitute the bottom face 21 of the holder 20.

A recess portion 26 is formed near an end portion of the bottom face of the holder 20 on the side in the +Y direction, and a reflection portion 24 (reflecting plate, position correction plate, failure detection plate) serving as a reflective area is provided in the bottom face of the recess portion 26. The reflection portion 24 is provided at a place facing the light-emitting portion 92 and the light-receiving portion 94 when the reflection portion 24 is located immediately above the detection portion 90 as a result of the holder 20 moving back and forth. The reflection portion 24 is formed by a mirror capable of totally reflecting incident light. When the reflection portion 24 is located immediately above the detection portion 90, upon the light radiated from the light-emitting portion 92 entering the reflection portion 24, the reflected light that is totally reflected at the reflection portion 24 enters the light-receiving portion 94. Note that the reflection portion 24 may be formed by coating the bottom face of the recess portion 26 of the holder 20 with a reflector, rather than providing the reflection portion 24 as a separate body that can be separated from the holder 20.

Non-reflective members serving as non-reflective areas having a lower reflectance than that of the reflection portion are provided at both ends of the recess portion 26 in the main scanning direction HD (Y-axis direction), i.e., both ends of the reflection portion 24 in the main scanning direction HD when the reflection portion 24 is seen from the side of the detection portion 90. The non-reflective members are made of a light-absorbing material, and the bottom faces of the non-reflective members (the bottom face of the holder) when seen from the side of the detection portion 90 inclines with respect to the sub-scanning direction VD (X-axis direction). In the present embodiment, the non-reflective members are made of black-colored polystyrene, for example, and the bottom faces thereof incline at a predetermined angle θ relative to the sub-scanning direction VD. The non-reflective member is made of the same material as the holder and is integrally formed therewith. Note that, as mentioned above, the non-reflective members include the first portion, which is a portion peripheral to the reflection portion 24 and having inclined faces inclining in the sub-scanning direction in the present embodiment. Here, since the non-reflective members are provided in the areas corresponding to these inclined faces, the portions where the non-reflective members are provided coincide with the first portion. However, a modified mode is possible in which the non-reflective members are provided in portions other than the first portion, for example.

As shown in FIGS. 9A and 9B, the center position of the reflection portion 24 is separate in the main scanning direction HD from the center position of the adjacent opening portion 22 by the distance b0. The center position of this opening portion 22 is separate from the center position of the opening portion 22 adjacent thereto on the side opposite to the reflection portion 24 by the distance b1. The center positions of other two adjacent opening portions 22 are also separate from each other by the distance b1.

The prisms 170 provided in the ink containing chambers 130 of the ink cartridges IC1 to IC4 each have an inclined face 170R and an inclined face 170L. The inclined face 170R and the inclined face 170L constitute an edge line of the prism 170 that is aligned with the sub-scanning direction VD (X-axis direction) intersecting the main scanning direction HD (Y-axis direction). The prism 170 has a rectangular equilateral triangle shape with a vertex angle formed by the inclined face 170R and the inclined face 170L, as seen from the X-axis direction.

The prism 170 is made of a member, such as polypropylene, that transmits the radiated light from the light-emitting portion 92. The state of reflection of the radiated light entering each prism 170 from the light-emitting portion 92 differs depending on the refractive index of a fluid (ink or air) that is in contact with the inclined faces 170R and 170L. The opening portions 22 are arranged at positions facing the light-emitting portion 92 and the light-receiving portion 94 provided in the detection portion 90 when the respective prisms 170 in the ink cartridges IC1 to IC4 are located immediately above the detection portion 90 as a result of the holder 20 moving back and forth.

Upon the carriage CR including the holder 20 moving in the main scanning direction HD (Y-axis direction), the ink cartridges IC1 to IC4 sequentially pass above the detection portion 90 (+Z direction). Then, the radiated light from the light-emitting portion 92 is reflected at the prism 170 in each ink cartridge IC through the corresponding opening portion 22, and the reflected light is received by the light-receiving portion 94. The detection portion 90 outputs a result of light reception by the light-receiving portion 94 as an output signal corresponding to the position of the carriage CR (prism 170). In the present embodiment, the ink near-end determination for each ink cartridge IC and correction of the detection position for performing the ink near-end determination are performed, based on this output signal of the detection portion 90 that corresponds to the position of the carriage CR.

Figure 10:
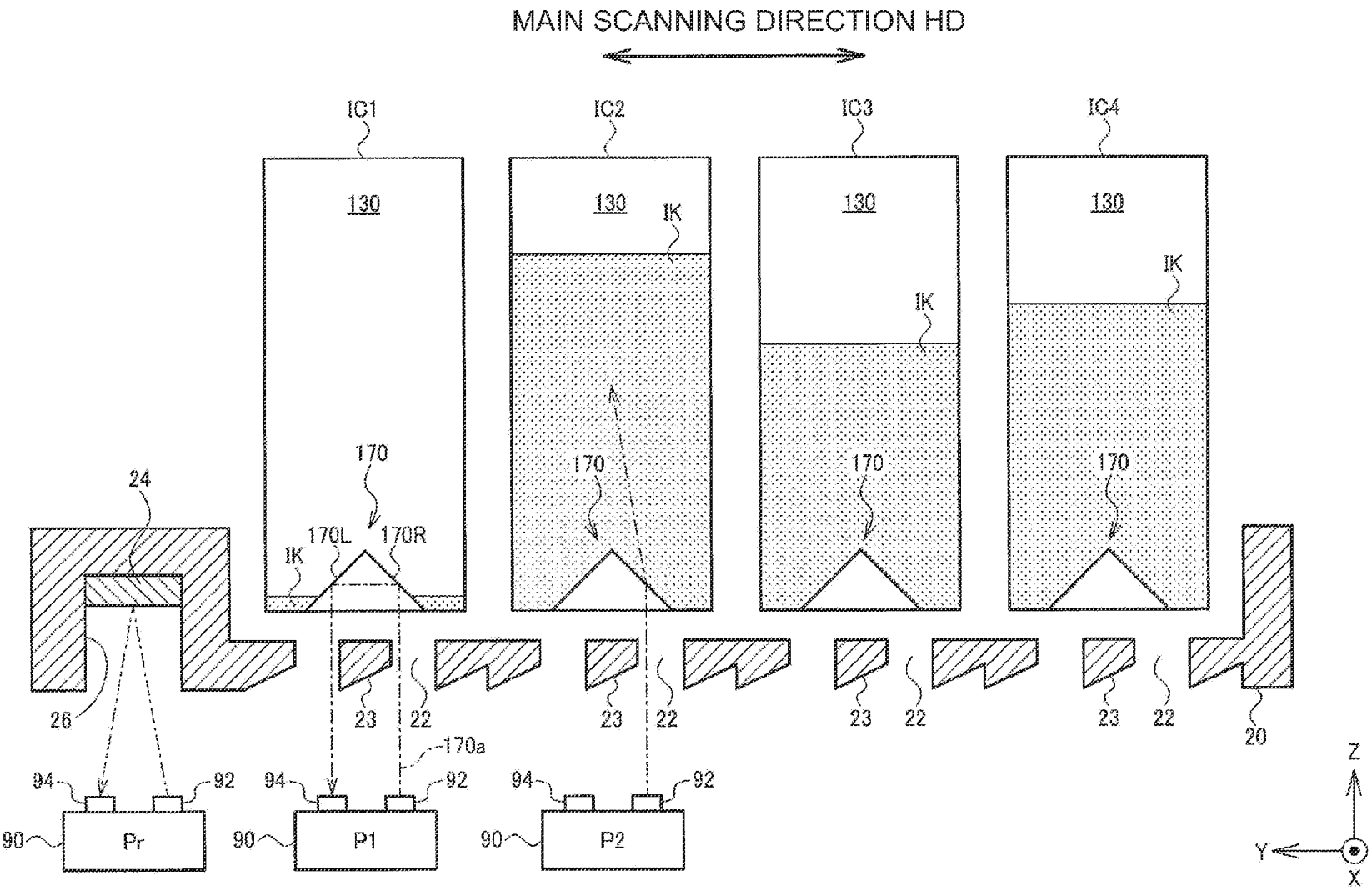
FIG. 10 is a diagram for illustrating a state of reflected light when light is radiated from a light-emitting portion.

FIG. 10 is a diagram for illustrating a state of reflected light at the time when light is radiated from the light-emitting portion 92. The holder 20 shown in FIG. 10 is driven by the aforementioned carriage motor 33, and thereby moves back and forth in the main scanning direction HD above the detection portion 90 fixed to the printer 10. When the holder 20 moves above the detection portion 90, the positional relationship between the holder 20 and the detection portion 90 relatively changes, as indicated by exemplary positions Pr, P1, and P2 shown in FIG. 10.

At the position Pr, the detection portion 90 faces the reflection portion 24 provided in the bottom face of the recess portion 26. At this position, the reflection portion 24 is located immediately above the detection portion 90, and the center position between the light-emitting portion 92 and the light-receiving portion 94 substantially coincides with the center position of the reflection portion 24 in the main scanning direction HD. When the reflection portion 24 is located immediately above the detection portion 90, since the reflection portion 24 is made of a mirror, light R25 radiated from the light-emitting portion 92 toward the reflection portion 24 is totally reflected at the reflection portion 24, and this reflected light is received by the light-receiving portion 94.

Figure 11:
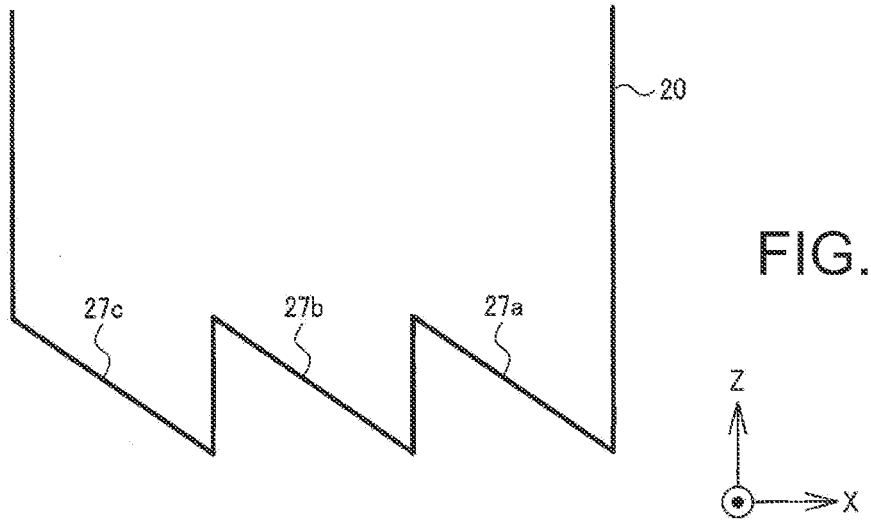
FIG. 11 shows an example in which the holder has a plurality of inclined faces.

Note that the configuration of the holder 20 according to the present embodiment is not limited to the above-described configuration. For example, the first portion (the holder bottom face 21 peripheral to the reflection portion 24) of the holder 20 may have a plurality of steps of inclined faces that incline in the second direction. FIG. 11 is a diagram illustrating the holder 20 having the plurality of steps of inclined faces. FIG. 11 is a schematic diagram of an XZ cross-section enlarging one side of the bottom face (the first portion) of the holder 20 indicated by oblique lines in FIG. 9A.

As shown in FIG. 11, for example, three inclined faces 27*a* to 27*c* are provided in a saw blade-like shape in the X-axis direction in the first portion of the holder 20. The length and the inclination angle of the inclined faces 27*a* to 27*c* in the X-axis direction are substantially the same.

As described above using FIG. 1B, the longer the distance from the detection portion 90 to the bottom face of the holder 20 is (i.e., if described based on the height relative to the aforementioned reflection portion 24, the lower the height of the holder 20 is), the more likely the position correction processing is to be affected by ambient light due to it. For this reason, the distance from the detection portion 90 to the holder 20 is to be as small as possible, while taking the relationship with other elements into consideration as well.

Figure 12A:
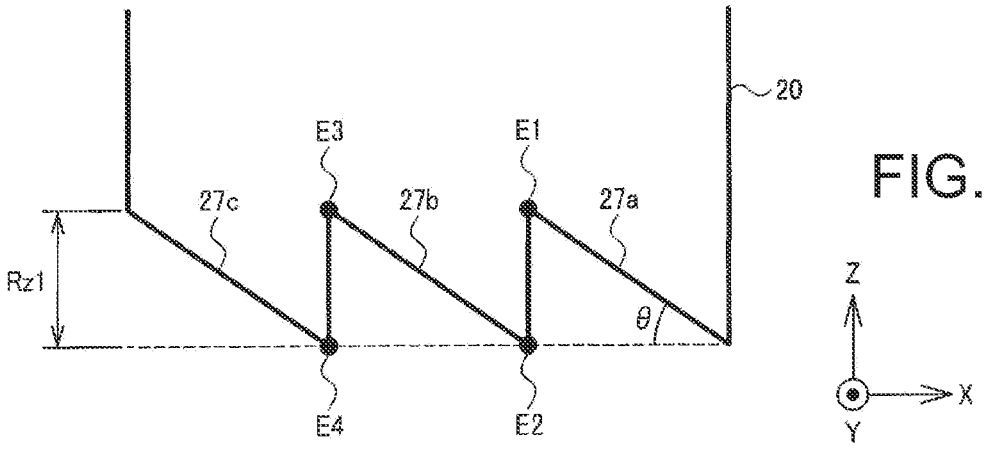
FIGS. 12A and 12B are diagrams illustrating a difference between a holder having an inclined face and a holder having a plurality of inclined faces.
Figure 12B:
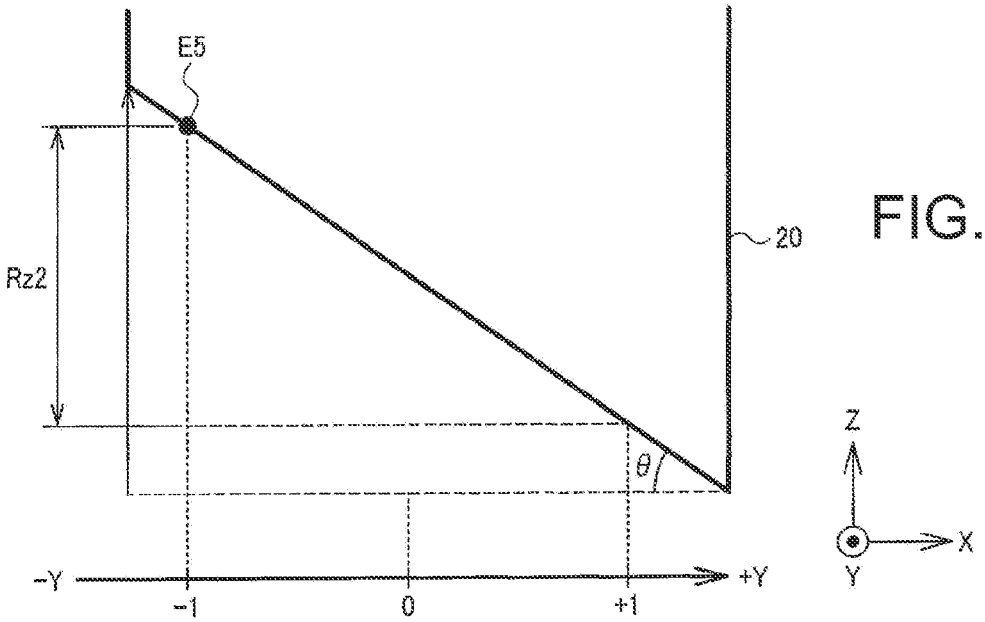

A comparison between the case where one inclined face is provided in the holder 20 and the case where a plurality of steps of inclined faces are provided therein is shown in FIGS. 12A and 12B. If the holder 20 has the plurality of steps of inclined faces that are arranged in a saw blade-like shape as in FIG. 11, the position of the holder bottom face on the Z-axis is within a range Rz1, as shown in FIG. 12A. Although the distance between the detection portion 90 and the holder 20 varies if a shift occurs in the relative positions thereof in the sub-scanning direction, the distance to a point E1 or E3 need only be considered to be the maximum distance in the case of FIG. 12A.

In contrast, in the case of one inclined face, the shape of the holder bottom face 21 is as shown in FIG. 12B. If the position shift of the detection portion 90 relative to the holder 20 in the sub-scanning direction is within the range from +1 to −1, the position of the holder bottom face on the Z-axis varies in a range Rz2, as shown in FIG. 12B. For this reason, in the case of FIG. 12B, the distance to E5 needs to be considered to be the maximum distance between the detection portion 90 and the holder 20.

As is also clear from FIGS. 12A and 12B, as a result of providing a plurality of steps of inclined faces, the distance between the detection portion 90 and the holder 20 can be expected to be shortened. As a result, it is possible to suppress the influence of ambient light and perform accurate position correction processing.

Note that, in the case of providing a plurality of inclined faces (here, first to Nth inclined faces) and shortening the distance between the detection portion 90 and the holder 20, a configuration of may be employed in which the first portion of the holder 20 has the first to Nth (N is an integer larger than or equal to 2) inclined faces arranged in the second direction, and the distance between the detection portion 90 and the holder 20 at an end point of an ith (i is an integer that satisfies $1 \leq i < N$) inclined face on the side of an i+1th inclined face is larger than the distance between the detection portion 90 and the holder 20 at an end point of the i+1th inclined face on the side of the ith inclined face.

Here, in the example in FIG. 12A, N=3, and a first inclined face, a second inclined face, and a third inclined face correspond to 27*a*, 27*b*, and 27*c*, respectively. If i=1, the end point of the ith inclined face on the side of the i+1th inclined face corresponds to the end point E1 of the inclined face 27*a* in the −X direction, and if i=2, it corresponds to the end point E3 of the inclined face 27*b* in the −X direction. Similarly, if i=1, the end point of the i+1th inclined face on the side of the ith inclined face corresponds to the end point E2 of the inclined face 27*b* in the +X direction, and if i=2, it corresponds to the end point E4 of the inclined face 27*c* in the +X direction. Note that each inclined face here is a face whose direction in the Z-axis direction from the plane in which the detection portion 90 is arranged monotonously increases (i.e., whose Z-axis coordinate value monotonously increases) in the direction (the −X direction) from the ith inclined face toward the i+1th inclined face.

Considering the direction from the ith inclined face toward the i+1th inclined face, within the ith inclined face, the distance from the detection portion 90 is largest at the position at which this inclined face ends, i.e., at the end point (E1) on the side of the i+1th inclined face. At the position (E2) where the ith inclined face ends and the i+1th inclined face starts, the distance to the detection portion 90 shortens once (the distance between the detection portion 90 to E2<the distance between the detection portion 90 to E1) due to the aforementioned condition. As an example, as shown in FIG. 12A, the distance at the start point of the i+1th inclined face need only be made equal to the distance at the start point of the ith inclined face.

With this configuration, the distance to the detection portion 90 necessarily decreases once at the joint between two inclined faces among the plurality of inclined faces, and it is accordingly possible to reduce the expected value of the distance in the Z-axis direction to the plane in which the detection portion 90 is arranged, as compared with the holder having one inclined face without a point at which the distance decreases as in FIG. 12B. For example, when the distance in the Z-axis direction between the point at which an inclined face starts and the plane in which the detection portion 90 is arranged is the same, the distance in the Z-axis direction between the end point and the plane in which the detection portion 90 is arranged can be reduced.

As described above, a plurality of liquid containers can be attached to and detached from the holder 20 according to the present embodiment, and the holder 20 can hold the liquid containers. The holder 20 has the plurality of opening portions 22 each provided at a position facing the corresponding prism among the plurality of prisms 170 when the plurality of liquid containers are installed. Although the inclined faces inclining in the sub-scanning direction are provided in the first portion of the holder 20 peripheral to the reflection portion 24 in the present embodiment, this first portion may be a portion defined based on the positions of the reflection portion 24 and the plurality of opening portions 22. For example, the first portion may be a portion between the reflection portion 24 and a first opening portion among the plurality of opening portions 22.

In the case of FIG. 9A, a first area in which the inclined faces inclining in the sub-scanning direction according to the present embodiment is constituted by two portions indicated by oblique lines. The first area includes an area between the reflection portion 24 and the opening portion 22, i.e., an area on the side in the −Y direction of the two oblique-line areas in FIG. 9A. Note that the first opening portion here need only be the opening portion provided at a position closest to the reflection portion 24 among the plurality of opening portions 22, for example. In the example in FIG. 9A, the first opening portion is the opening portion 22 corresponding to the ink cartridge IC1.

However, the first portion that is peripheral to the reflection portion 24 and has the inclined faces inclining in the sub-scanning direction is not limited to the portion between the reflection portion 24 and the first opening portion. For example, the first portion may be a portion on the side opposite to the first opening portion among the plurality of the opening portion 22 with respect to the reflection portion 24.

That is to say, the first area includes an area opposite to the opening portions 22 with respect to the reflection portion 24, i.e., the area on the side in the +Y direction of the two oblique-line areas in FIG. 9A. Note that the "opposite side" here need only be considered based on the main scanning direction HD. For example, the space on the side that includes the first opening portion and the space on the side that does not include the first opening portion can be conceived by dividing the space into two by a plane (an XZ plane) that is centered about the reflection portion 24 and is orthogonal to the main scanning direction HD. In this case, the portion on the side opposite to the first opening portion is a portion located in the space that does not include the first opening portion of the aforementioned two spaces.

In the present embodiment, the inclined faces inclining in the sub-scanning direction are provided at two portions indicated by oblique lines in FIG. 9A. That is to say, the aforementioned first portion refers to, in the narrow sense, both a portion between the reflection portion and the first opening portion among the plurality of opening portions 22 and a portion on the side opposite to the first opening portion among the plurality of opening portions 22 with respect to the reflection portion 24.

Each of the portions between the plurality of opening portions has inclined faces inclining in the first direction, as shown in FIG. 9B.

As described later, in the ink near-end determination as well, reflection at the bottom face of the holder 20 is a noise factor that decreases the determination accuracy. For this reason, inclined faces may also be provided in portions peripheral to the prisms 170. In the ink near-end determination, the light that is originally to be detected is reflected light from the prisms 170, and is accordingly weaker light than the reflected light at the reflection portion 24. For this reason, noise needs to be more sufficiently reduced than in the position correction processing, and it is also important to suppress reflection at the bottom face of the holder 20.

However, in the ink near-end determination, a predetermined threshold value is compared with a signal level, as described later using FIG. 14B. At this time, the distance between the detection portion 90 and the holder 20 directly affects the signal level, and variation of this distance is not favorable. Variation here refers to variation due to a shift of the relative positions of the holder 20 and the detection portion 90 in the sub-scanning direction, as shown in FIG. 12B.

While there is a difference in the variation range between the case of a plurality of steps and the case of one inclined face as shown in FIGS. 12A and 12B, when the inclined faces incline in the sub-scanning direction, the distance between the holder 20 and the detection portion 90 varies due to a relative position shift between the holder 20 and the detection portion 90 in the sub-scanning direction. For this reason, the signal level changes in accordance with the position shift, and there is a possibility that appropriate ink near-end determination cannot be performed with a preset threshold value.

Accordingly, in the holder 20 in the present embodiment, the inclining direction of the inclined faces is a direction parallel with the main scanning direction HD in the portions peripheral to the prisms 170. However, if a configuration is possible in which a relative position shift between the holder 20 and the detection portion 90 in the sub-scanning direction can be sufficiently suppressed, or in which, even if a position shift occurs, this shift does not cause variation of the signal level which affects the ink near-end determination, the inclined faces may be configured to incline in the sub-scanning direction VD also in the portions peripheral to the prisms 170.

4. INK NEAR-END DETERMINATION TECHNIQUE

Next, the ink near-end determination method according to the present embodiment will be described. FIGS. 13A and 13B and FIGS. 14A and 14B are diagrams illustrating the ink near-end determination method. FIGS. 13A and 13B show a cross-section in a YZ plane that passes through the prism 170 in each ink cartridge IC. FIGS. 13A and 13B each show a state where the positional relationship between the prism 170 and the detection portion 90 is a positional relationship (detection position) in which the amount of remaining ink can be detected for the ink near-end determination.

FIG. 14A shows a cross-section in a YZ plane that passes through the prism 170 in each ink cartridge IC. FIG. 14A shows a state where the positional relationship between the prism 170 and the detection portion 90 is not a positional relationship in which the amount of remaining ink can be detected for the ink near-end determination. FIG. 14B shows an exemplary characteristic of detection voltage when one of the ink cartridges IC passes above the detection portion 90.

Figure 13B:
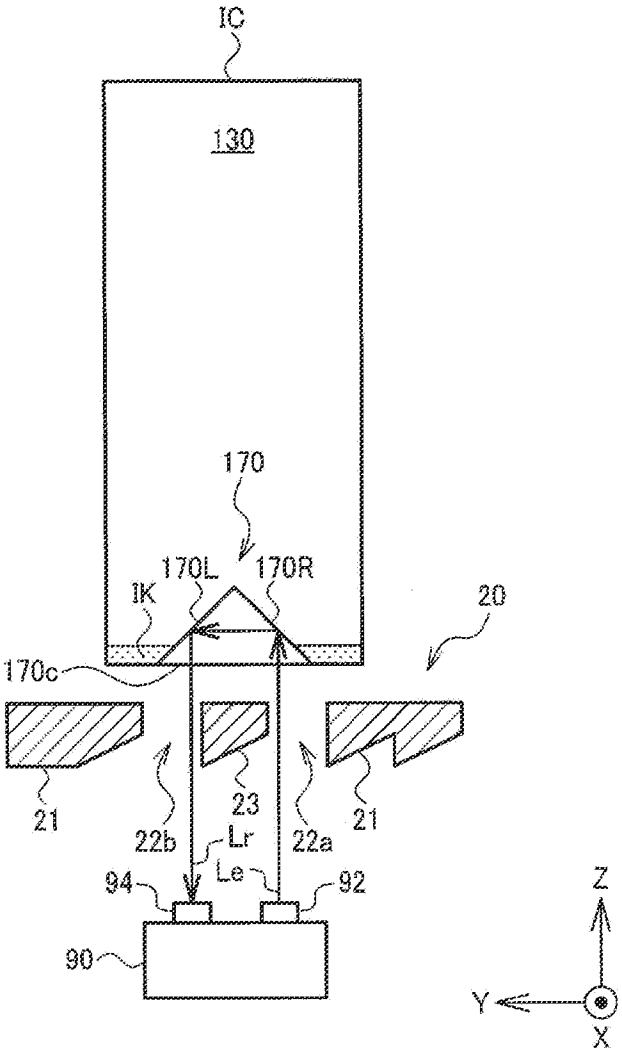
FIGS. 13A and 13B are diagrams illustrating an ink near-end determination method.
Figure 13A:
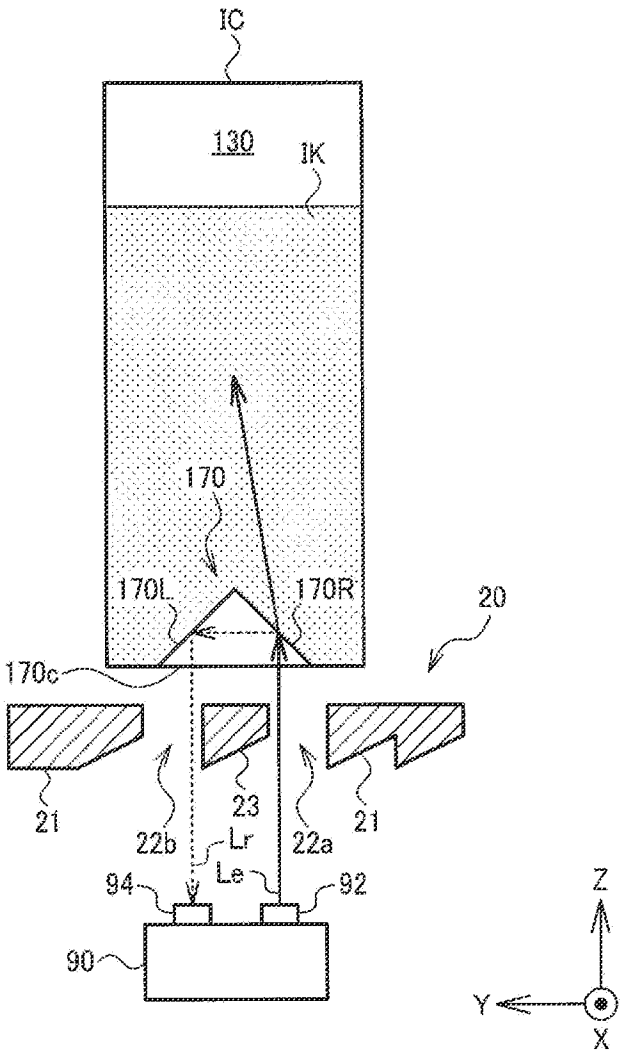

As shown in FIG. 13A, the inclined faces 170R and 170L of the prism 170 face inward of the ink containing chamber 130. The inclined face 170R is a face perpendicular to the inclined face 170L, for example, and the inclined face 170R and the inclined face 170L are arranged symmetrically with respect to a plane parallel with an XZ plane. When the ink containing chamber 130 is filled with the ink IK, the inclined faces 170R and 170L are in contact with the ink IK.

When the ink cartridge IC is filled with the ink IK, radiated light Le entering the prism 170 from the light-emitting portion 92 enters the ink IK from the inclined face 170R. In this case, the amount of reflected light Lr reflected at the inclined faces 170R and 170L is very small, and accordingly the light-receiving portion 94 hardly receives the light. For example, assuming that the refractive index of the ink is 1.5, which is almost similar to the refractive index of water, if the prism 170 is made of polypropylene, the critical angle of total reflection at the inclined faces 170R and 170L is approximately 64 degrees. Since the incident angle is 45 degrees, the radiated light Le is not totally reflected at the inclined faces 170R and 170L, and enters the ink IK.

Suppose that, as shown in FIG. 13B, the ink IK in the ink cartridge IC is consumed for printing, and the ink cartridge IC is not filled with the ink IK. It is assumed that, of the inclined faces 170R and 170L of the prism 170, at least a part that the radiated light Le from the light-emitting portion 92 enters is in contact with the air. In this case, the radiated light Le entering the prism 170 from the light-emitting portion 92 is totally reflected at the inclined faces 170R and 170L, and exits as the reflected light Lr to the outside of the prism 170.

Accordingly, when the ink cartridge IC is not filled with the ink IK, the light-receiving portion 94 receives the totally reflected light Lr, and accordingly, strong detection voltage is obtained. For example, in a case where the refractive index of the air is 1 and the prism 170 is made of polypropylene, the critical angle of total reflection at the inclined faces 170R and 170L is approximately 43 degrees. Since the incident angle is 45 degrees, the radiated light Le entering the prism 170 is totally reflected at the inclined faces 170R and 170L.

In FIG. 14B, the horizontal axis indicates relative positions of the prism 170 and the detection portion 90, and the vertical axis indicates detection voltage that is output from the detection portion 90 at each position on the horizontal axis. The position at the time when the center of the prism 170 coincides with the center of the detection portion 90 (e.g., the positional relationship between the ink cartridge IC and the detection portion 90 shown in FIG. 13A) is "0" on the horizontal axis. The center of the detection portion 90 is the center between the light-emitting portion 92 and the light-receiving portion 94 in the main scanning direction HD.

A position PK1 is a position at which the relative positions of the center of the prism 170 and the center of the detection portion 90 are shifted from the position "0" in the main scanning direction HD, and that corresponds to the opening portion 22*b* of the holder 20, as in the positional relationship between the ink cartridge IC and the detection portion 90 shown in FIG. 14A. Similarly, a position PK2 is a position at which the relative positions of the center of the prism 170 and the center of the detection portion 90 are shifted from the position "0" in the main scanning direction HD, and that corresponds to the opening portion 22*a* of the holder 20.

As shown in FIG. 14B, the detection voltage approaches upper limit voltage Vmax as the amount of light received by the light-receiving portion 94 is closer to zero, and the detection voltage approaches lower limit voltage Vmin as the amount of light received by the light-receiving portion 94 is larger. When the amount of received light exceeds a predetermined value, the detection voltage is saturated and reaches the lower limit voltage Vmin. The upper limit voltage Vmax and the lower limit voltage Vmin correspond respectively to upper limit voltage and lower limit voltage in the range of voltage that the light-receiving portion 94 outputs to the collector terminal in FIG. 3, for example.

The detection voltage that is output from the detection portion 90 varies in accordance with the relative positions of the detection portion 90 and the prism 170. SIK indicates a detection voltage characteristic in the case where the ink cartridge IC is filled with the ink IK, as described in FIG. 13A. In this case, since the amount of light received by the light-receiving portion 94 is small, the detection voltage is close to Vmax at the position "0". At the positions PK1 and PK2 at which the relative positions of the center of the prism 170 and the center of the detection portion 90 are shifted from the position "0" in the main scanning direction HD, peaks Spk1 and Spk2 are respectively generated due to the reflected light Lr from the bottom face 170*c* of the prism 170. These peaks Spk1 and Spk2 will be described later.

SEP indicates a detection voltage characteristic in the case where the ink cartridge IC is not filled with the ink IK, as described in FIG. 13B. In this case, since the amount of light received by the light-receiving portion is large, the detection voltage reaches Vmin (or approaches Vmin) at the position "0". Thus, the characteristic of the detection voltage significantly differs depending on whether or not the ink cartridge IC is filled with the ink IK. In the present embodiment, the ink near-end determination for each ink cartridge IC is performed by detecting this difference in the detection voltage characteristic.

Specifically, a threshold value Vth is set between a peak value Vpk1 and the lower limit voltage Vmin, based on the peak value Vpk1 of the detection voltage characteristic SIK. In a detection range DPR in which the ink cartridge IC passes above the detection portion 90, if the detection voltage of the detection portion 90 is smaller than the threshold value Vth, it is determined that the ink cartridge IC is in the ink near-end state. If the detection voltage is larger than or equal to the threshold value Vth, it is determined that the ink is remaining.

As shown in FIG. 14A, the light-blocking portion 23 that blocks the light from the light-emitting portion 92 is provided at the center of each opening portion 22 of the holder 20. A part of the radiated light Le entering the bottom face 170*c* of the prism 170 from the light-emitting portion 92 is reflected at the bottom face 170*c*, and is received as the reflected light Lr by the light-receiving portion 94. The reflection angle of this reflected light Lr at the bottom face 170*c* is equal to the incident angle of the radiated light Le at the bottom face 170*c*. As indicated by the detection voltage characteristic SIK in FIG. 14B, the reflected light Lr from the bottom face 170*c* is not detected at the position since the light-blocking portion 23 is present, and the peaks Spk1 and Spk2 are detected respectively at the positions PK1 and PK2 since the light-blocking portion 23 is not present.

Here, the position PK1 is the position at which the center of the opening portion 22*b* and the center of the detection portion 90 in the main scanning direction HD coincide with each other, and the position PK2 is the position at which the center of the opening portion 22*a* and the center of the detection portion 90 in the main scanning direction HD coincide with each other. Note that, although the reflected light Lr from the bottom face 170*c* is also detected when totally reflected light returns from the prism 170, the peaks Spk1 and Spk2 are not generated since the detection voltage is buried in the signal of the totally reflected light, as indicated by the detection voltage characteristic SEP.

Figure 15:
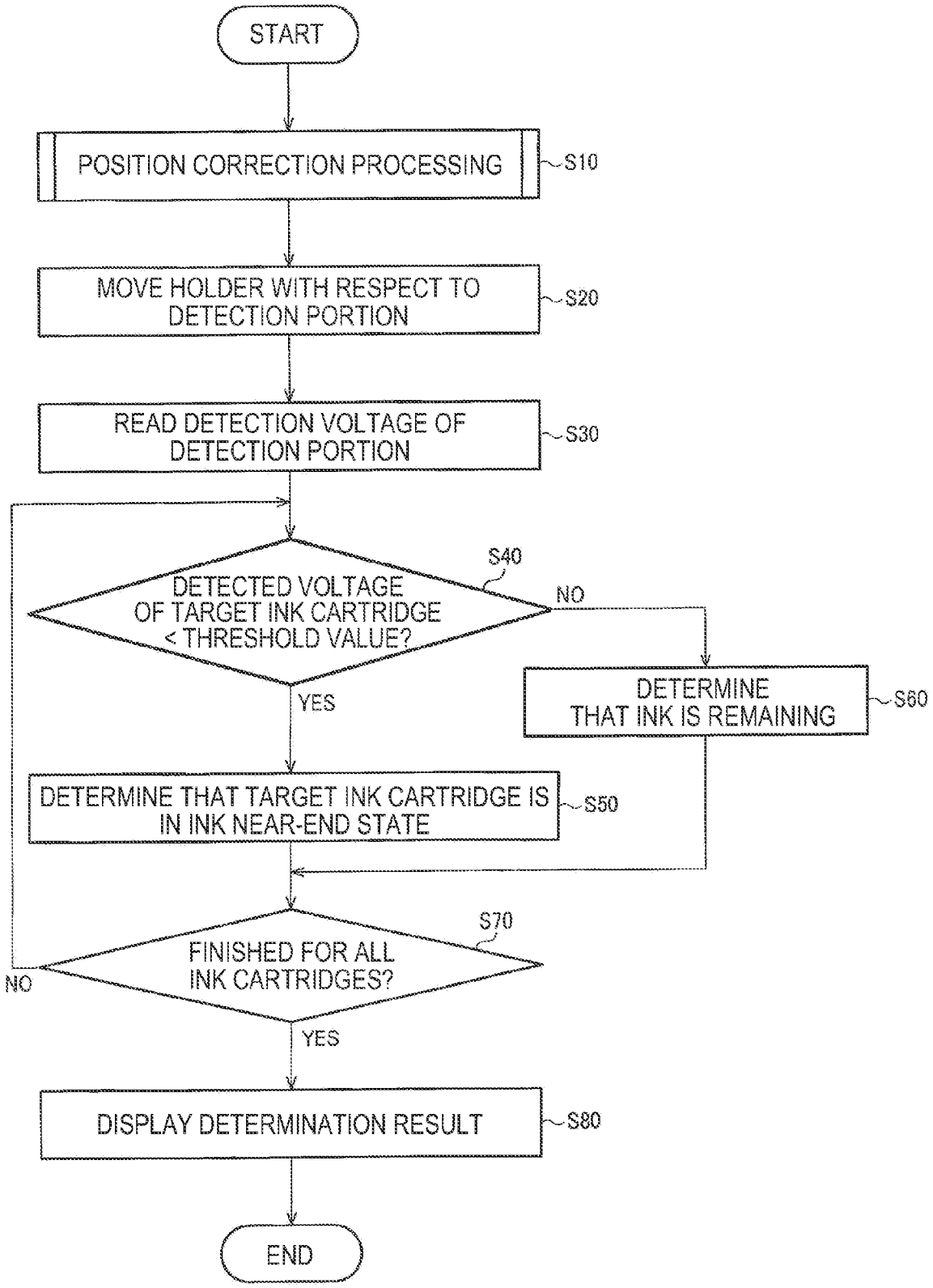
FIG. 15 is a flowchart showing ink near-end determination processing.

FIG. 15 is a flowchart showing ink near-end determination processing. The ink near-end determination processing is executed at a timing such as when starting the printer 10 or when replacing the ink cartridges IC, for example.

As shown in FIG. 15, in the ink near-end determination processing, initially, the control unit 40 (the position correction portion 44) performs the position correction processing in the main scanning direction HD for the respective prisms 170 in the ink cartridges IC1 to IC4 (step S10). The details of the position correction processing will be described later.

Next, in step S20, the control unit 40 moves the holder 20 in the main scanning direction HD such that the prisms 170 in the ink cartridges IC1 to IC4 pass above the detection portion 90. Here, the reflected light radiated from the light-emitting portion 92 and reflected at the prisms 170 in the ink cartridges IC1 to IC4 is received by the light-receiving portion 94 at the positions P1' to P4' after the correction processing in step S10.

Subsequently, the control unit 40 reads the detection voltage (the output voltage Vc) of the detection portion 90 (the light-receiving portion 94) corresponding to the amount of the reflected light from the respective prisms 170 in the ink cartridges IC1 to IC4 in the detection range including the positions P1' to P4' after the correction (step S30).

Next, the control unit 40 (the remaining amount determination portion 42) compares the detection voltage of the determination target ink cartridge IC with a detection voltage threshold value for the ink near-end determination, based on the result of measurement of the detection voltage in step S30 (step S40).

If the detection voltage of the determination target ink cartridge IC is smaller than the threshold value (step S40: YES), the control unit 40 determines that the determination target ink cartridge IC is in the "ink near-end" state (step S50). On the other hand, if the detection voltage of the determination target ink cartridge IC is not smaller than the threshold value (step S40: NO), the control unit 40 determines that "ink is remaining" in the determination target ink cartridge IC (step S60).

Next, the control unit 40 determines whether or not the ink near-end determination has finished for all ink cartridges IC1 to IC4 (step S70). If the ink near-end determination has finished for all ink cartridges IC (step S70: YES), the control unit 40 displays the amount of remaining ink in the respective ink cartridges IC1 to IC4 (whether or not the ink cartridges IC1 to IC4 are in the ink near-end state), on the display unit 46 provided in the printer 10 and the computer 48 connected to the printer 10 (step S80).

On the other hand, if any ink cartridge IC remains for which the ink near-end determination has not finished (step S70: NO), the processing returns to step S40, and the ink near-end determination is performed for the remaining ink cartridge IC. Thus, it is sequentially determined whether or not the respective ink cartridges IC1 to IC4 are in the ink near-end state.

5. POSITION CORRECTION TECHNIQUE

The positions of the ink cartridges IC are shifted due to various tolerances. Assumed tolerances include, for example, an inclination of the carriage CR, a shift in attachment thereof, an error of the rotary encoder, and variation of a response speed of an electronic circuit (e.g., detection portion 90), or for example, a mechanical position shift such as driving of the carriage. The control unit 40 perceives the positions of the ink cartridges, based on the count value of the rotary encoder, and these positions perceived by the control unit 40 are shifted from the actual positions of the ink cartridges IC due to the tolerances in some cases.

In a case of not correcting this position shift, it is necessary to consider a position shift range including all expected tolerances and determine a detection range DPR in FIG. 14B so as to be able to correctly perform the ink near-end detection within this position shift range. Then, the detection range DPR becomes wider than the interval between the two peaks Spk1 and Spk2, and the threshold value Vth cannot be set close to the peak voltage Vpk1 at the peaks Spk1 and Spk2.

Then, if the peak in the case indicated by SEP where the ink runs out is almost as large (Vpk1) as the peaks Spk1 and Spk2 caused due to the reflected light from the incident plane of the prism, the ink near-end state will not be able to be correctly detected using the threshold value Vth. This situation may occur when, for example, the amount of emitted light and the amount of received light decrease since an ink mist is attached to the detection portion 90, and the ratio (so-called S/N ratio) between noise including the peaks Spk1 and Spk2 and the detection voltage generated due to total reflection becomes small.

For this reason, in the present embodiment, the position of each ink cartridge IC perceived based on the count value of the rotary encoder is corrected based on the reflected light from the reflection portion 24. Since the position shift caused due to the tolerances is corrected by this correction, the position of each ink cartridge IC can be associated with a count value of the rotary encoder with high accuracy.

Figure 16:
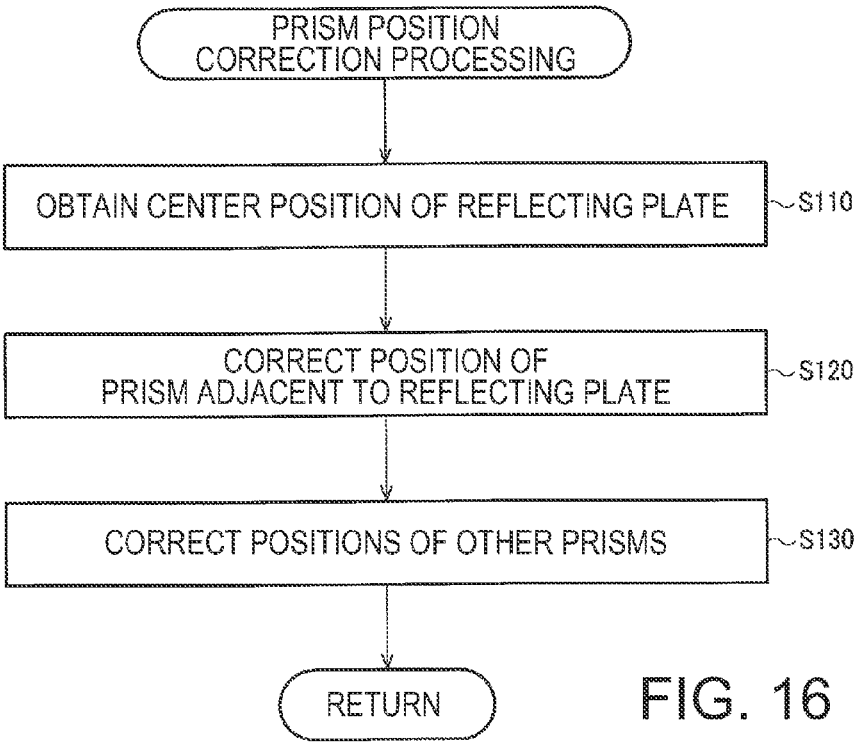
FIG. 16 is a flowchart showing the details of prism position correction processing.
Figure 17:
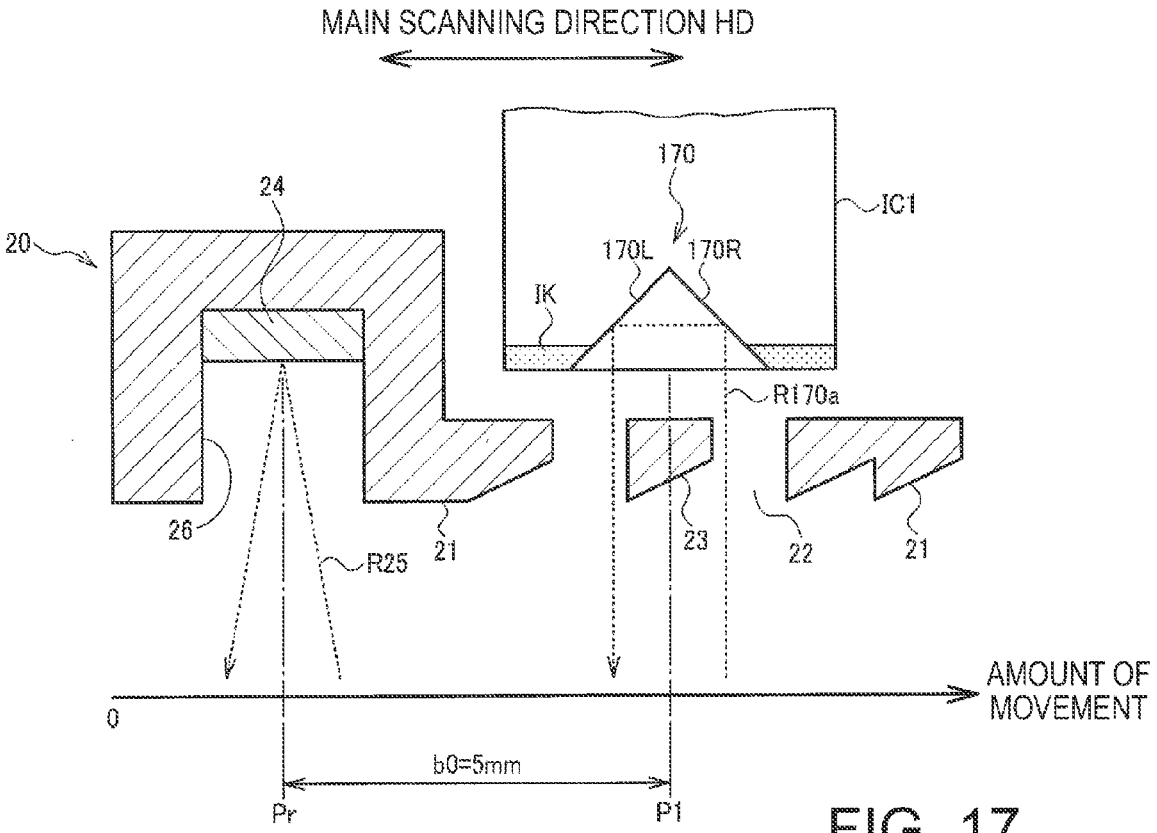
FIG. 17 is a diagram for illustrating a state of reflected light of light radiated from the light-emitting portion, with regard to the reflection portion and the ink cartridge.

Next, a position correction processing method in the present embodiment will be described in detail, using a flowchart in FIG. 16. Initially, the control unit 40 causes the light-emitting portion 92 to emit light, and thereafter moves the holder 20 in the main scanning direction HD such that the reflection portion 24 provided in the holder 20 passes above the detection portion 90. The control unit 40 then obtains the center position of the reflection portion 24 in the main scanning direction HD, based on the reflected light from the reflection portion 24 at the time when the reflection portion 24 passes above the detection portion 90 (step S110). In the case of the example in FIGS. 17 and 18, the control unit 40 obtains the center position of the reflection portion 24, based on a change of output voltage from a "non-reflecting period 1" to a "reflecting period (a period during which reflection from the reflection portion is received)", then to a "non-reflecting period 2" shown in FIG. 18. Specifically, initially, the control unit 40 sets a threshold value of the output voltage for the reflection portion 24. During the "reflecting period (reflection portion)", the intersection point of this threshold value and the gradually decreasing output voltage is regarded as one optical end Pr'1 of the reflection portion 24, and the intersection point of the threshold value and the gradually increasing output voltage is regarded as the other optical end Pr'2 of the reflection portion 24. The control unit 40 then determines that the center position between the optical ends Pr'1 and Pr'2 is the center position Pr' of the reflection portion 24. That is to say, the optical position corresponding to the center position Pr of the reflection portion 24 shown in FIG. 17 is obtained as the center position Pr' of the reflection portion 24 in FIG. 18, based on the output voltage from the detection portion 90.

Figure 18:
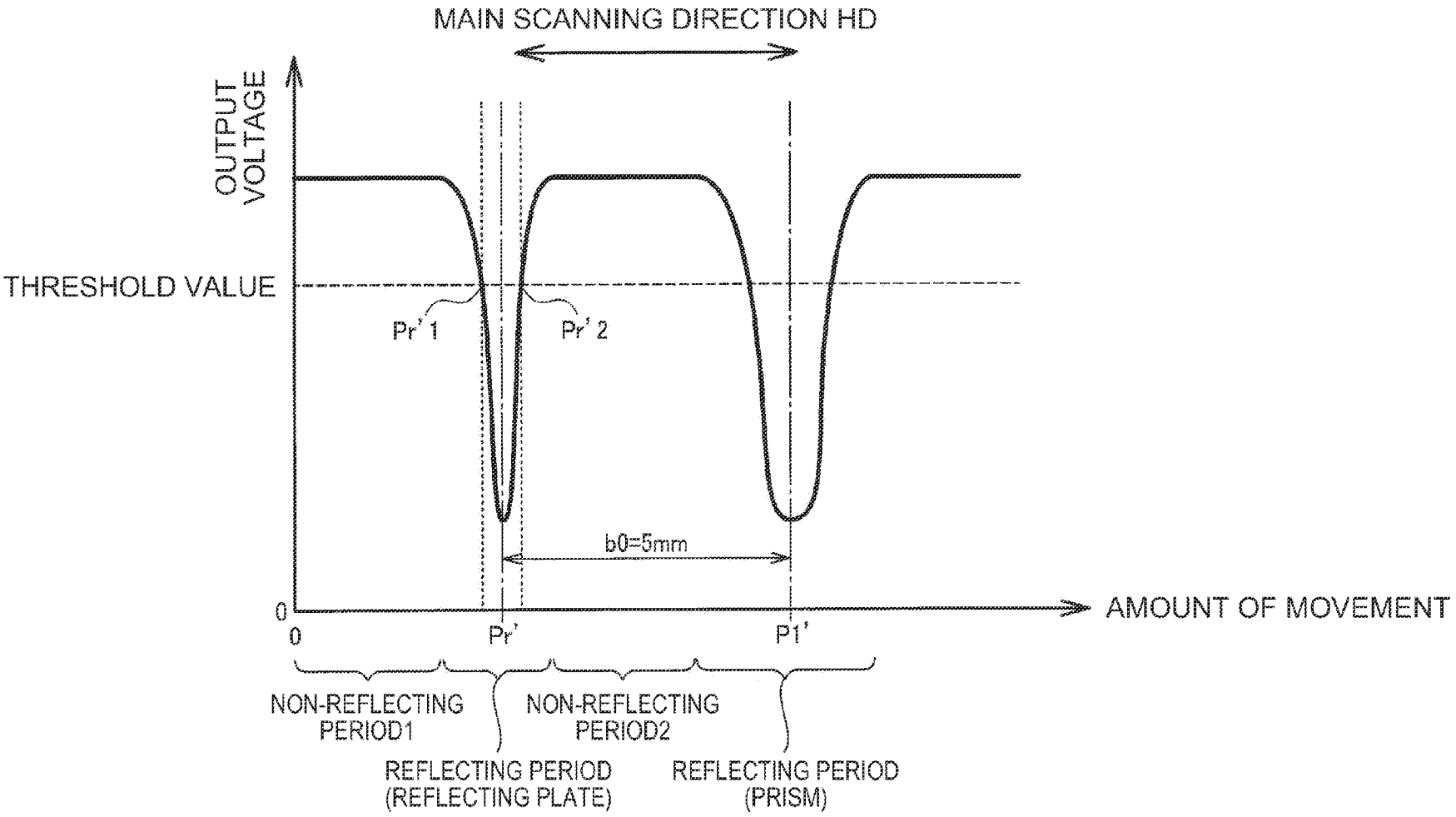
FIG. 18 is a diagram showing an exemplary result of measurement of output voltage from the detection portion with respect to each state of reflected light.

Next, the control unit 40 corrects the position of the prism 170 in the ink cartridge IC1, which is adjacent to the reflection portion 24, in the main scanning direction HD, based on the center position of the reflection portion 24 obtained in step S110 (step S120). In the case of the example in FIGS. 17 and 18, the control unit 40 obtains the center position P1' of the prism 170 in the ink cartridge IC1, based on the obtained center position Pr' of the reflection portion 24, and performs correction if a position shift has occurred with respect to the center position P1 serving as a reference point when the detection portion 90 performs measurement. Specifically, initially, the control unit 40 obtains the center position P1' of the prism 170 in the ink cartridge IC1, based on the obtained center position Pr' of the reflection portion 24. In the present embodiment, the distance b0 from the center position Pr of the reflection portion 24 to the center position P1 of the prism 170 in the ink cartridge IC1 shown in FIG. 17 is 5 mm. Accordingly, the position P1' that is separate from the center position Pr' of the reflection portion 24 by 5 mm shown in FIG. 18 is obtained as the center position P1' of the prism 170. If the obtained center position P1' of the prism 170 is different from the center position P1 of the prism 170 serving as the reference point shown in FIG. 17, the center position of the prism 170 to be used when the detection portion 90 performs measurement is corrected in conformity to the center position P1'.

Next, the control unit 40 corrects the positions of the prisms 170 in the other ink cartridges IC2 to IC4 in the main scanning direction HD, similarly to the prism 170 in the ink cartridge IC1, based on the interval between adjacent opening portions 22 being the distance b1 as shown in FIG. 9A (step S130).

However, the position correction technique is not limited to the above-described technique, and a detection signal corresponding to the reflection portion 24 and a detection signal corresponding to each ink cartridge may be used in combination. Specifically, a modification is possible in which primary correction processing is performed for correcting the center position of each prism 170 based on the center position of the reflection portion 24 serving as a reference point. Then, peak detection is further performed on the detection voltage of each ink cartridge IC at the position after being subjected to the primary correction, and secondary correction processing is performed for correcting the center position of each prism 170, based on the detected peak positions, thereby further improving the accuracy of the position correction processing. For example, the following processing may be performed as the secondary processing. Regarding a cartridge in which ink remains, the distance between the center position between two detected peaks and the center position of the reflection portion is obtained. A difference between this distance and the designed distance is obtained. The average of the differences among the cartridges is obtained. The center position of each cartridge is corrected, considering the averaged difference in addition to the designed difference.

6. MODIFICATIONS

As described above, the liquid consuming apparatus in the present embodiment includes a control portion (the control unit 40) that performs processing for correcting the positional relationship between the holder 20 and the detection portion 90 when determining the amount of remaining liquid, based on the detection signal from the detection portion 90 that indicates a result of reception of reflected light at the reflection portion 24. However, the processing performed by the control unit 40 is not limited thereto, and the control unit 40 can also perform other kind of processing. For example, the control portion can adjust the amount of light emitted from the light-emitting portion 92 in the position correction processing. Furthermore, a failure in the detection portion 90 can be detected, such as by determining that the detection portion 90 has failed if the reflected light from the reflection portion 24 is not detected.

Also, a first liquid container and a second liquid container whose capacity is smaller than that of the first liquid container may be able to be attached to and detached from the holder 20, and the holder 20 may be able to hold the first and second liquid containers. The reflection portion 24 of the holder 20 may be provided on the side of the second liquid container in the holder 20.

Figure 19A:
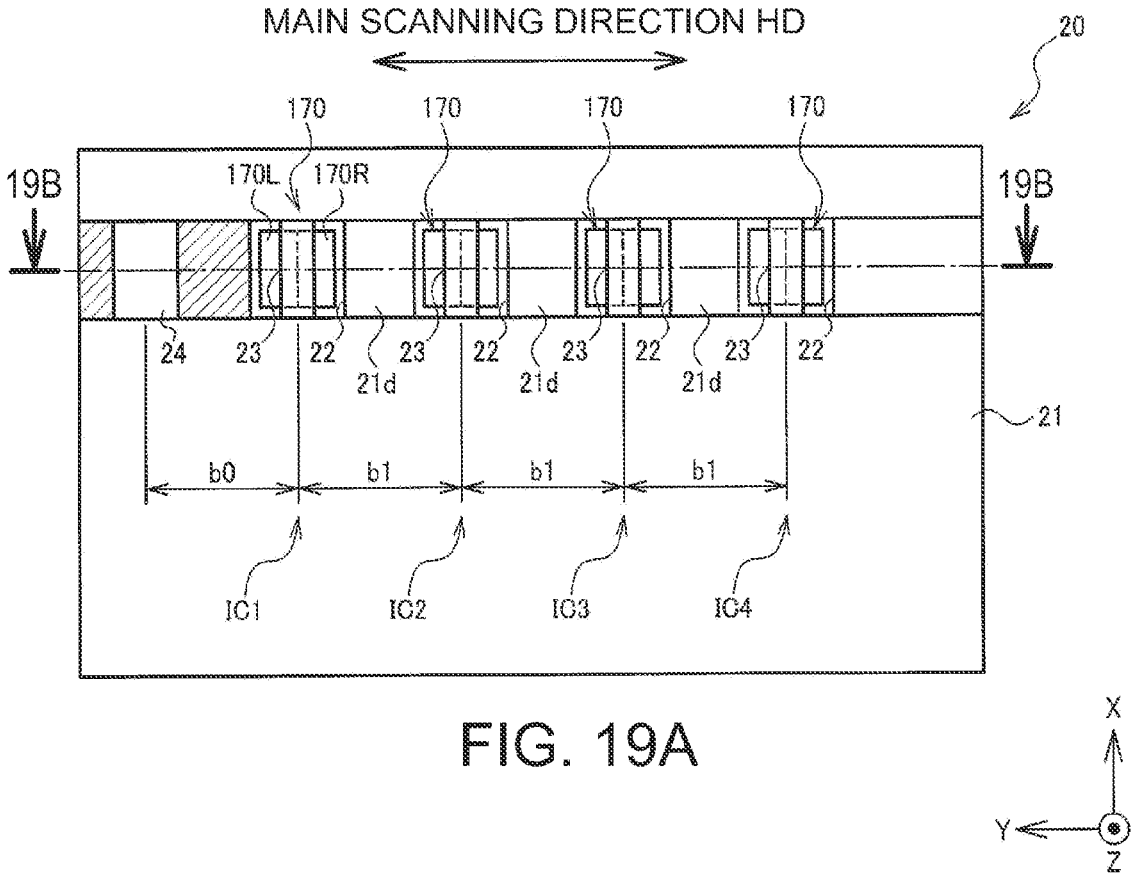
FIGS. 19A and 19B are diagrams illustrating a detailed configuration of the holder according to the present embodiment.
Figure 19B:
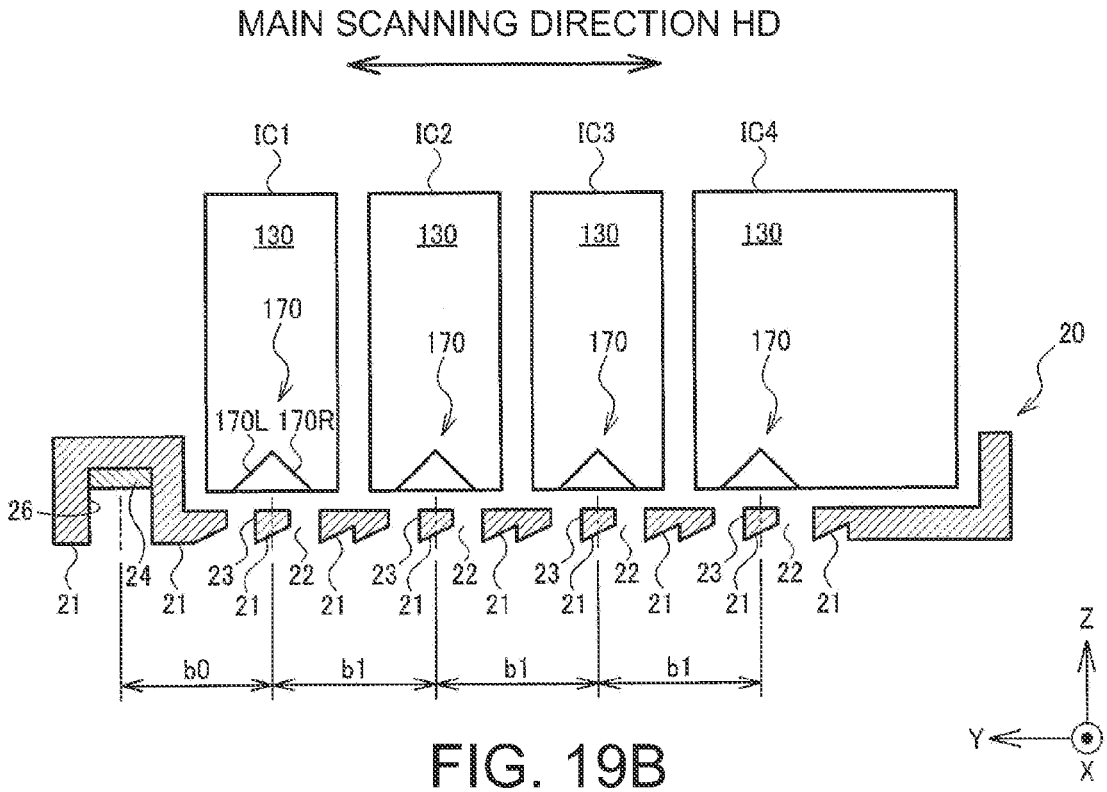

For example, in some existing printer products, the capacity of a black ink cartridge is about twice the capacity of other ink cartridges such as a cyan ink cartridge. A configuration of the holder 20 in this case is shown in FIGS. 19A and 19B. With the configuration of the holder 20 shown in FIGS. 19A and 19B, the distance from an opening portion corresponding to the ink cartridge IC4 (e.g., black) to the end point of the holder 20 on the side of this opening portion can be elongated, without changing the position of the opening portion 22.

Although the influence of ambient light in the periphery of the reflection portion 24 has been described in FIG. 1B, the fact that ambient light can cause noise also applies to the ink near-end determination using the prisms 170. As can be understood from FIG. 19B, the structure of the reflection portion 24 and the periphery thereof can function as a blocking portion that suppresses incidence of ambient light during the ink near-end determination using the opening portions 22 (particularly, the opening portion 22 corresponding to IC1). Specifically, since the distance from the end point of the holder 20 in the main scanning direction to the opening portion 22 can be elongated, the influence of ambient light can be suppressed.

In a large-capacity ink cartridge, it is possible to similarly elongate the distance from the end point of the holder 20 in the main scanning direction to the opening portion 22 and suppress the influence of ambient light by arranging the prism 170 while biasing it to one side. That is to say, when an ink cartridge whose capacity is larger than that of other ink cartridges is included, this ink cartridge is provided at an end portion of the holder 20 and can thereby function as a blocking portion.

With the above-described configuration, if the periphery of the reflection portion 24 and the large-capacity ink cartridge each function as a blocking portion, the influence of ambient light can be efficiently suppressed by providing an opening portion between the reflection portion 24 and the large-capacity ink cartridge.

Although the holder 20 according to the above embodiment has a configuration in which the opening portions 22 are provided in the bottom face 21, the invention is not limited to this mode. The opening portions 22 need only be provided at positions at which the respective prisms 170 and the detection portion 90 face each other. For example, the opening portions 22 may be provided is in a side portion of the holder 20.

The holder 20 according to the above embodiments and modifications have a configuration in which four ink cartridges IC are installed, and the number of opening portions 22 corresponds to the number of the prisms 170 in the ink cartridges IC. However, the invention is not limited thereto. The number of installed ink cartridges IC and the number of corresponding opening portions 22, 52, 62, and 72 may be other than four.

The above embodiments and modifications have a configuration in which the light-emitting portion 92 and the light-receiving portion 94 provided in the detection portion 90 are arranged so as to be aligned with the main scanning direction HD (Y-axis direction) in which the carriage CR moves. However, the invention is not limited to this mode. For example, a configuration may be employed in which the light-emitting portion 92 and the light-receiving portion 94 are arranged so as to be aligned with the direction (X-axis direction) perpendicular to the main scanning direction HD.

The above embodiments and modifications have been described, taking, as an example, a case where the carriage CR moves in which the holders 20, 20A, 50, 60, and 70 are carried, the ink cartridges IC1 to IC4 being able to be attached to and detached from these holders, and the detection portion 90 is fixed to the printer body. However, the invention is not limited to this mode. For example, the carriage CR in which the detection portion 90 is carried may move, and the holders 20, 20A, 50, 60, and 70, to and from which the ink cartridges IC1 to IC4 can be attached and detached, may be fixed to the printer body. Any configuration may be employed in which the ink cartridges IC1 to IC4 and the detection portion 90 relatively move with respect to each other. Furthermore, a configuration may also be employed in which the holders 20, 20A, 50, 60, and 70 are fixed, and the detection portion 90 is arranged in the carriage CR including the print head 35.

The above embodiments and modifications have been described, using an example in which the invention is applied to a printer and ink cartridges. However, the invention is not limited to this mode. For example, the invention may also be used in a liquid consuming apparatus that ejects and discharges liquid other than ink, and can also be applied to a liquid vessel that contains such liquid. The liquid vessel of the invention can be used in various kinds of liquid consuming apparatus including a liquid ejection head that ejects miniscule droplets, and the like. "Droplets" refers to the state of the liquid discharged from the liquid consuming apparatus, and includes droplets having a granular shape, a tear-drop shape, and a shape having a thread-like trailing end. Furthermore, "liquid" mentioned here may be any kind of material that can be ejected by the liquid consuming apparatus. For example, the liquid need only be a material whose substance is in the liquid phase, and encompasses high or low viscosity liquid materials, as well as liquid materials such as sols, gel water, other inorganic solvents, organic solvents, solutions, liquid resins, and liquid metals (metal melts). Furthermore, the liquid is not limited to being a one-state substance, and also encompasses a substance in which functional material particles made of a solid substance such as pigment or metal particles are dissolved, dispersed, or mixed in a solvent. Representative examples of the liquid include ink such as that described in the above embodiment, and liquid crystal. Here, "ink" encompasses general water-based ink and oil-based ink, as well as various types of liquid compositions such as gel ink and hot melt-ink. Specific examples of the liquid consuming apparatus may include, for example, a liquid consuming apparatus that ejects liquid containing, in the form of dispersion or dissolution, a material such as an electrode material or a color material to be used in manufacturing or the like of a liquid crystal display, an EL (electro-luminescence) display, a surface-emitting display, or a color filter, a liquid consuming apparatus that ejects biological organic matter to be used in manufacturing of a biochip, and a liquid consuming apparatus that is used as a precision pipette and ejects liquid serving as a sample. Furthermore, it is also possible to employ a liquid consuming apparatus that ejects lubricating oil in a pinpoint manner to a precision machine such as a watch or a camera, a liquid consuming apparatus that ejects transparent resin liquid such as ultraviolet-cured resin onto a substrate, in order to form a micro-hemispherical lens (optical lens) or the like to be used in an optical communication device or the like, or a liquid consuming apparatus that ejects an etchant that is acid, alkaline, or the like, for etching a substrate or the like.

The entire disclosure of Japanese Patent Application No. 2014-042990, filed on Mar. 5, 2014 is expressly incorporated herein by reference.

What is claimed is:

1. A liquid consuming apparatus comprising:

a detection portion having a light-emitting portion and a light-receiving portion;

a holder configured to hold a plurality of liquid containers, each provided with a prism, each of the plurality of liquid containers being attachable to and detachable from the holder, the holder having a plurality of opening portions provided at positions facing the prisms respectively when the liquid containers are installed, and a reflection portion; and a moving portion that relatively moves the holder in a first direction with respect to the detection portion, wherein the light-emitting portion and the light-receiving portion are substantially aligned with the first direction, the plurality of opening portions and the reflection portion are substantially aligned with the first direction, the reflection portion is positioned near an end portion of the holder on the side in the first direction, a first portion of the holder that is peripheral to the reflection portion in a plan view of the holder as seen from the side of the detection portion has an inclined face that inclines in a second direction intersecting the first direction, and a part between two adjacent opening portions has a face inclined in the first direction.

2. The liquid consuming apparatus according to claim 1, wherein the first portion has a plurality of steps of inclined faces that incline in the second direction.

3. The liquid consuming apparatus according to claim 2, wherein the first portion has a first to Nth (N is an integer larger than or equal to 2) inclined faces arranged in the second direction, and the distance between the detection portion and the holder at an end point of an ith (i is an integer that satisfies $1 \leq i < N$) inclined face on the side of an i+1th inclined face is larger than the distance between the detection portion and the holder at an end point of the i+1th inclined face on the side of the ith inclined face.

4. The liquid consuming apparatus according to claim 1, further comprising a control portion that performs processing for correcting a positional relationship between the holder and the detection portion when determining the amount of remaining liquid, based on a detection signal from the detection portion indicating a light reception result of reflected light at the reflection portion.

5. The liquid consuming apparatus according to claim 1, wherein the first portion is between the reflection portion and a first opening portion among the opening portions.

6. The liquid consuming apparatus according to claim 1, wherein the first portion is on the side opposite to a first opening portion among the opening portions with respect to the reflection portion.

7. The liquid consuming apparatus according to claim 1, wherein the plurality of liquid containers includes a first liquid container and a second liquid container whose capacity is smaller than that of the first liquid container, and the reflection portion of the holder is provided in the holder on the side of the second liquid container.

8. The liquid consuming apparatus according to claim 1, wherein the second direction is a direction orthogonal to the first direction.

* * * * *